US008579590B2

(12) United States Patent
Nadvit et al.

(10) Patent No.: US 8,579,590 B2
(45) Date of Patent: Nov. 12, 2013

(54) TURBOMACHINERY BLADE HAVING A PLATFORM RELIEF HOLE, PLATFORM COOLING HOLES, AND TRAILING EDGE CUTBACK

(75) Inventors: Gregory M. Nadvit, Grand Prairie, TX (US); Andrew D. Williams, Balcraig (GB); Leone J. Tessarini, Baden-Daettwil (CH); Michel P. Arnal, Turgt (CH)

(73) Assignee: Wood Group Heavy Industrial Turbines AG, Neuenhof (CH)

( * ) Notice: Subject to any disclaimer, the term of this patent is extended or adjusted under 35 U.S.C. 154(b) by 838 days.

(21) Appl. No.: 12/763,422

(22) Filed: Apr. 20, 2010

(65) Prior Publication Data

US 2010/0329888 A1 Dec. 30, 2010

Related U.S. Application Data

(63) Continuation-in-part of application No. 12/486,939, filed on Jun. 18, 2009, and a continuation-in-part of application No. 12/367,868, filed on Feb. 9, 2009, and a continuation-in-part of application No. 11/383,988, filed on May 18, 2006, now Pat. No. 7,862,300, and a continuation-in-part of application No. 11/383,986, filed on May 18, 2006, now abandoned.

(51) Int. Cl.
*F01D 5/08* (2006.01)

(52) U.S. Cl.
USPC ..... 416/97 R; 416/193 A

(58) Field of Classification Search
USPC ..... 416/193 A, 97 R
See application file for complete search history.

(56) References Cited

U.S. PATENT DOCUMENTS

| | | | | |
|---|---|---|---|---|
| 6,120,249 | A | 9/2000 | Hultgren et al. | |
| 6,190,128 | B1 | 2/2001 | Fukuno et al. | |
| 6,190,130 | B1 * | 2/2001 | Fukue et al. | 416/97 R |
| 6,490,791 | B1 * | 12/2002 | Surace et al. | 29/889.1 |
| 7,862,300 | B2 * | 1/2011 | Nadvit et al. | 416/193 A |
| 2005/0095129 | A1 * | 5/2005 | Benjamin et al. | 416/97 R |
| 2007/0269313 | A1 | 11/2007 | Nadvit et al. | |
| 2007/0269316 | A1 | 11/2007 | Williams et al. | |

OTHER PUBLICATIONS

International Search Report for PCT/US2011/032868, dated Jul. 7, 2011.

* cited by examiner

*Primary Examiner* — Richard Edgar
(74) *Attorney, Agent, or Firm* — Baker Botts L.L.P.

(57) ABSTRACT

A method is disclosed that includes providing a turbomachinery blade having an airfoil connected to a platform in a root region of the turbomachinery blade. The airfoil has a trailing edge extending from the root region to a tip distal from the root region. The method further includes forming a blind relief hole in the platform proximate the trailing edge of the airfoil, and forming a plurality of cooling holes in the platform.

5 Claims, 21 Drawing Sheets

TURBOMACHINERY BLADE HAVING A PLATFORM RELIEF HOLE, PLATFORM COOLING HOLES, AND TRAILING EDGE CUTBACK

CROSS-REFERENCE TO RELATED APPLICATIONS

This application is a continuation-in-part of application Ser. No. 11/383,988, entitled "Turbomachinery Blade Having a Platform Relief Hole," filed on May 18, 2006 now U.S. Pat. No. 7,862,300, application Ser. No. 12/367,868, entitled "Turbomachinery Blade Having a Platform Relief Hole," filed on Feb. 9, 2009, application Ser. No. 12/486,939, entitled "Turbine Blade Having Platform Cooling Holes," filed on Jun. 18, 2009, and application Ser. No. 11/383,986, entitled "Turbine Blade with Trailing Edge Cutback and Method of Making Same," filed on May 18, 2006 now abandoned, each of which is hereby incorporated in its entirety by reference.

FIELD OF THE INVENTION

The present invention relates generally to techniques for reducing or preventing cracks in gas turbine rotor blades and their platforms, and more specifically to a turbine rotor blade having one or more of a platform relief hole, a plurality of cooling holes disposed in the platform, and a trailing edge cutback, and methods of making same.

BACKGROUND

The turbine section of gas turbine engines typically comprises multiple sets or stages of stationary blades, known as nozzles or vanes, and moving blades, known as rotor blades or buckets. FIG. 1 illustrates a typical rotor blade 100 found in the first stage of the turbine section, which is the section immediately adjacent the combustion section of the gas turbine and thus is in the region of the turbine section that is exposed to the highest temperatures. Known problems with such blades 100 include premature cracking at the root trailing edge 104, and cracking and/or delamination of a thermal barrier coating ("TBC") in the platform region 106 due to the heat stresses in this region of the blade. As shown in FIG. 1, the cracking 104 typically commences at a root trailing edge cooling channel 110*a* located on a trailing edge 112 of an airfoil 102 of the blade 100 adjacent the platform 108. This root trailing edge cooling channel 110*a* is particularly vulnerable to thermal mechanical fatigue ("TMF") because of excessive localized stress that occurs during start-stop cycles and creep damage that occurs under moderate operating temperatures, i.e., during periods of base load operation. Because the root trailing edge cooling channel 110*a* is affected by both mechanisms, premature cracking 104 has been reported within the first hot gas path inspection cycle. If the cracking 104 is severe enough, it can force early retirement of the blade 100. As also shown in FIG. 1, in some cases the cracking in the platform region 106 is so severe that it results in breakage and separation of a substantial portion of the platform on the pressure side of the blade 100, leading to the early retirement of the blade. In order to prevent early retirement and to extend blade operational lifetime, various approaches have been proposed.

The principal damage at the root trailing edge cooling channel 110*a* can be consequence of the combination of mechanical stress due to centrifugal load and thermal stress that results from the significant temperature gradient present at the root trailing edge cooling channel 110*a*. The initial damage is generally relatively confined, i.e., the cracking 104 appears localized. This suggests that the blade 100 might be salvaged if the confined damage is removed. In order to restore the structural integrity of the blade 100 however, it is desirable to remove all of the original cracking 104. In other words, any removal of material from the trailing edge 112 should be of sufficient depth to eliminate the cracking 104. However, it is undesirable to remove too much material as this can reduce the strength of the blade 100 to the degree that new cracking 104 might form even more quickly.

In a previously proposed solution, an undercut is machined into the blade platform. An example of such an undercut can be found in FIG. 2, which illustrates an elliptical-shaped groove 150 which extends from the concave side of platform to the trailing edge side of the platform. This proposed solution purports to reduce the total stress level in the region of high stress, for example proximate the cooling channel closest to the platform in the root portion of the trailing edge.

The goal of the undercut approach is to alleviate both the mechanical stress and the thermal stress by relaxing the rigidity of that juncture where the airfoil and platform join. This approach has been implemented on both turbine and compressor blades, both as a field repair and a design modification. If a stress reduction is achieved, the concern is whether the undercut results in a high stress within the grooved region where material is removed. In other words, the success of the strategy turns on whether a balance can be achieved without creating a new area of stress within the blade.

There are two primary concerns raised with platform undercuts. First, whether the undercut will be effective in reducing the stress. Second, whether the stress produced in the undercut will be so high that it offsets the benefit of the undercut. The problem with prior undercut solutions is that they have had difficulty striking that balance. It is desired to have a solution which reduces the stress at the trailing edge and/or in the platform, but minimizes the stress in the region of the undercut. The present invention seeks to solve this problem, among others.

SUMMARY

The present invention relates generally to techniques for reducing or preventing cracks in gas turbine rotor blades and their platforms, and more specifically to a turbine rotor blade having a platform relief hole, a plurality of cooling holes disposed in the platform, and a trailing edge cutback, and methods of making same.

In one aspect, a method is disclosed that includes providing a turbomachinery blade having an airfoil connected to a platform in a root region of the turbomachinery blade. The airfoil has a trailing edge extending from the root region to a tip distal from the root region. The method further includes forming a blind relief hole in the platform proximate the trailing edge of the airfoil, and forming a plurality of cooling holes in the platform.

In another aspect, a method is disclosed that includes providing a turbomachinery blade having an airfoil connected to a platform in a root region of the turbomachinery blade. The airfoil has a trailing edge extending from the root region to a tip distal from the root region. The method further includes forming a blind relief hole in the platform proximate the trailing edge of the airfoil, and forming a trailing edge cutback in the turbomachinery blade. The cutback extends along the entire length of the trailing edge.

In another aspect, a method is disclosed that includes providing a turbomachinery blade having an airfoil connected to a platform in a root region of the turbomachinery blade. The airfoil has a trailing edge extending from the root region to a tip distal from the root region. The method further includes forming a plurality of cooling holes in the platform, and forming a trailing edge cutback in the turbomachinery blade. The cutback extends along the entire length of the trailing edge.

In another aspect, a turbomachinery blade is disclosed. The turbomachinery blade includes an airfoil connected to a platform in a root region of the turbomachinery blade. The airfoil has a trailing edge extending from the root region to a tip distal from the root region. The turbomachinery blade further includes a trailing edge cutback, and a blind relief hole in the platform proximate the trailing edge of the airfoil.

In another aspect, a turbomachinery blade is disclosed, where the turbomachinery blade includes an airfoil connected to a platform in a root region of the turbomachinery blade. The airfoil has a trailing edge extending from the root region to a tip distal from the root region. The turbomachinery blade further includes a trailing edge cutback, and a plurality of cooling holes in the platform.

In another aspect, a turbomachinery blade is disclosed, where the turbomachinery blade includes an airfoil connected to a platform in a root region of the turbomachinery blade. The airfoil has a trailing edge extending from the root region to a tip distal from the root region. The turbomachinery blade further includes a plurality of cooling holes in the platform, and a blind relief hole in the platform proximate the trailing edge of the airfoil.

The features and advantages of the present invention will be apparent to those skilled in the art. While numerous changes may be made by those skilled in the art, such changes are within the spirit of the invention.

BRIEF DESCRIPTION OF THE DRAWINGS

The following drawings form part of the present specification and are included to further demonstrate certain aspects of the present invention. The present invention may be better understood by reference to one or more of these drawings in combination with the description of embodiments presented herein. However, the present invention is not intended to be limited by the drawings.

FIGS. 16A and 16C show the blade platform in perspective view from above, and FIGS. 16B and 16D show the platform temperatures looking from below.

FIGS. 18A and 18C show the sectioned blade and platform looking down from above, while FIGS. 18B and 18D show the sectioned blade shank and platform looking up from below, respectively.

FIGS. 19A and 19C show the sectioned blade and platform looking down from above, while FIGS. 19B and 19D show the sectioned blade shank and platform looking up from below, respectively.

DETAILED DESCRIPTION

The present invention relates generally to techniques for reducing or preventing cracks in gas turbine rotor blades and their platforms, and more specifically to a turbine rotor blade having a platform relief hole, a plurality of cooling holes disposed in the platform, and a trailing edge cutback, and methods of making same.

As used herein, the terms "blind relief hole" or "blind hole" refer to an indention, cut-out, divot, shallow boring, or other volume of finite concavity. As would be understood by one of ordinary skill in the art with the benefit of this disclosure, a "blind relief hole" or "blind hole" would not permit through-flow of fluids or gases.

As used herein, the "surface" dimensions of a hole or channel refer to the dimensions along the plane defined by the locus of points where the hole or channel enters the surrounding medium.

As used herein, the terms "passages," "veins," "channels," and the like are each used to describe conduits for the flow of air or other cooling fluid. The use of different words for the various conduits is not intended to be limiting in any way, but instead is to assist the reader in fully understanding the interrelation between the various conduits.

If there is any conflict in the usages of words or terms in this specification and one or more patent or other documents that may be incorporated herein by reference, definitions that are consistent with this specification should be adopted for the purposes of understanding this invention.

Figure 1:
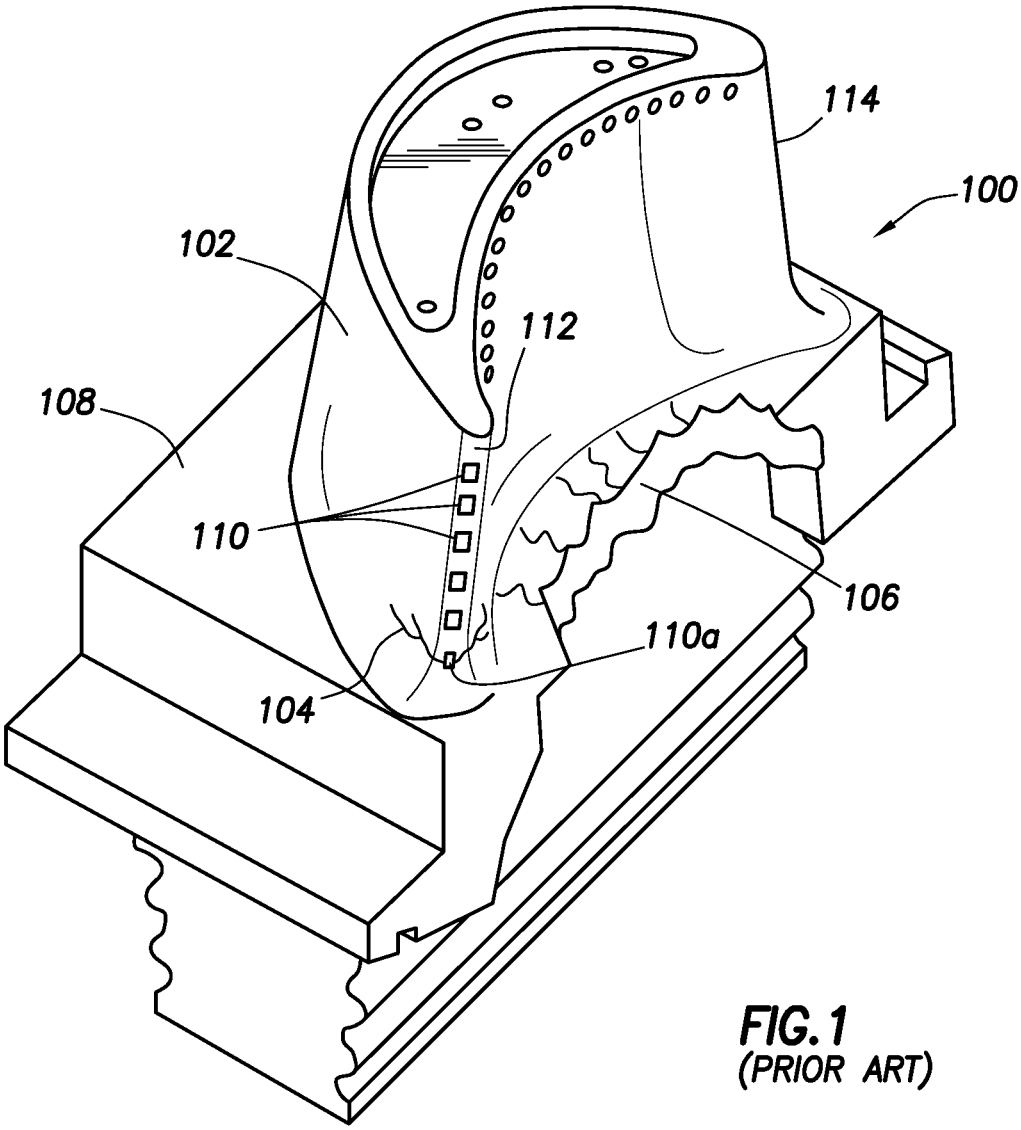
FIG. 1 (PRIOR ART)
FIG. 1 is a perspective view of a prior art turbine rotor blade having cracks in its trailing edge proximate the platform and a portion of its platform eroded.
Figure 2:
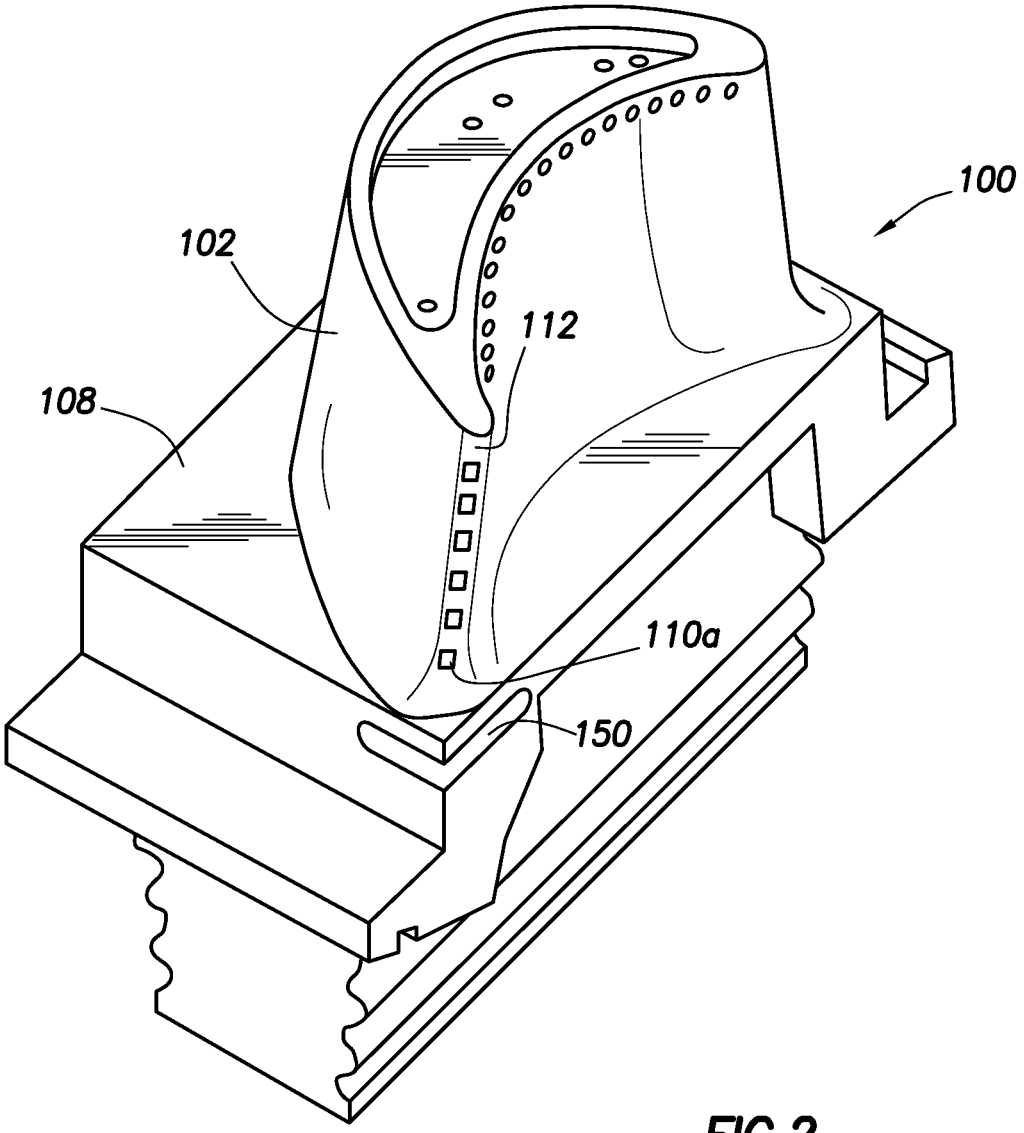
FIG.2 (PRIOR ART)
FIG. 2 is perspective view of a prior art turbine rotor blade having an elliptically-shaped groove in its platform proximate the trailing edge which seeks to reduce the stress in the trailing edge.
Figure 3:
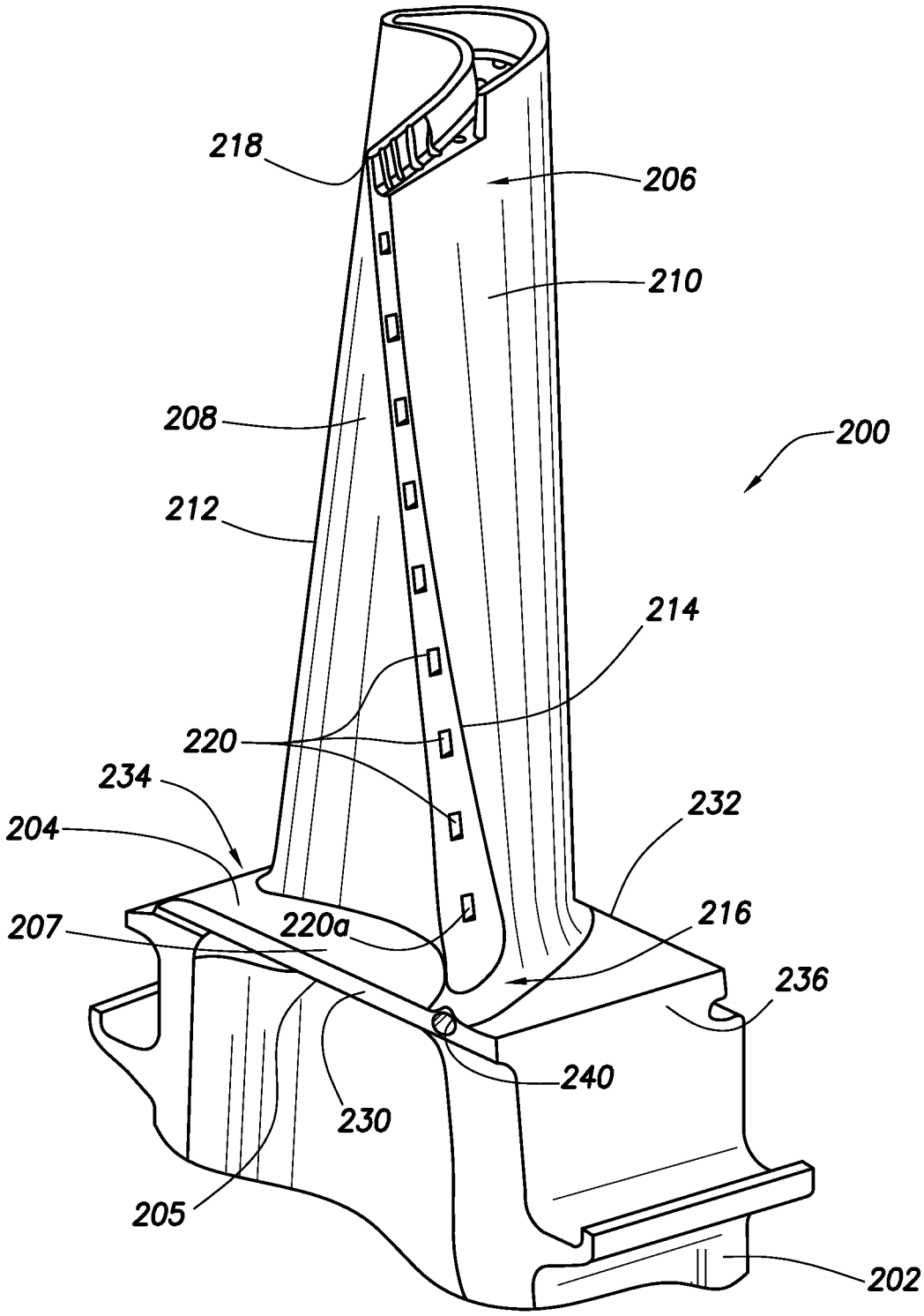
FIG. 3 is a perspective view of a turbine rotor blade in accordance with embodiments of the present invention having a relief hole in the concave side of the platform.

The present invention will now be generally described with reference to the following exemplary embodiments. Referring now to FIG. 3, a turbine rotor blade in accordance with embodiments of the present invention is shown generally by reference number 200. The turbine rotor blade 200 has three primary sections: a shank 202 which is designed to slide into a disc on the shaft of the rotor (not shown), a platform 204 connected to the shank 202, and an airfoil 206 connected to the platform 204. Platform 204 connects to shank 202 at a lower surface 205 of the platform 204, and to airfoil 206 at an upper surface 207 of the platform. Platform 204 has a thickness defined by the distance between the lower surface 205 and the upper surface 207. Moreover, platform 204 has four outside edges, which are generally orthogonal to the lower surface 205 and the upper surface 207. Generally, during the blade's 200 initial manufacture, the shank 202, platform 204 and airfoil 206 are all cast as a single part.

The airfoil 206 may be defined by a concave side wall 208, a convex side wall 210, a leading edge 212, and opposite trailing edge 214; the leading and trailing edges being the two areas where the concave side wall and convex side wall meet. The airfoil 206 may have a root 216 which is proximate the platform 204 and a tip (or shroud) 218 which is distal from the platform. As with prior art turbine rotor blades, air may be supplied to the inside cavity of the airfoil 206 (not shown) from the compressor to cool the inside of the airfoil. The cooling air may exit through a plurality of cooling channels 220, at least some of which may be located in the trailing edge 214. Typically, cracking 104 occurs proximate the cooling channel 220*a* nearest the root of the blade. One goal of the present invention is the prevention of the formation of these cracks and control of their future propagation.

Figure 4:
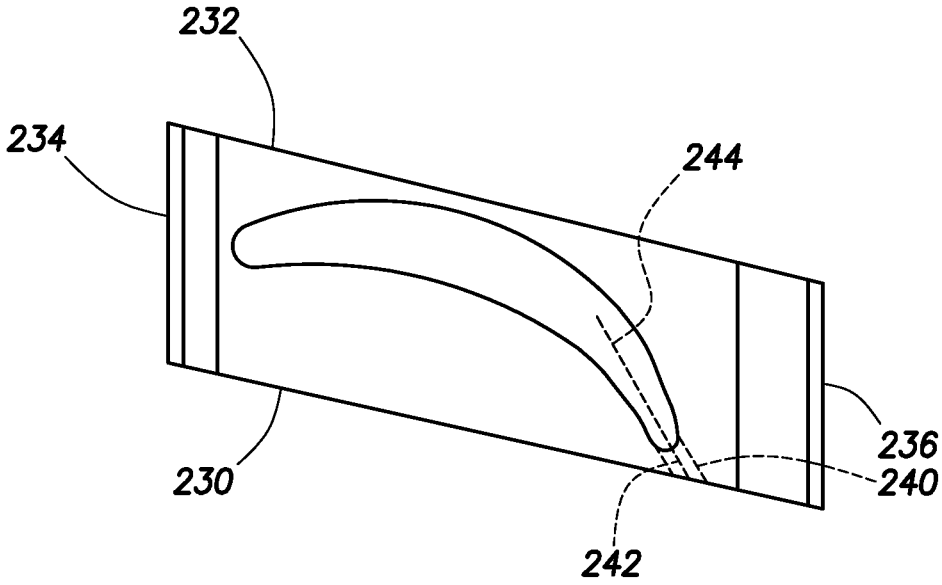
FIG. 4 is a cross-sectional view of the platform in accordance with embodiments of the present invention showing the orientation of the relief hole aligned with a mean camber line of the airfoil at the trailing edge.

The geometry of the airfoil 206 may be used to identify the sides of the platform 204. For example, the platform 204 may have a concave side 230 nearest the concave side wall 208 of the airfoil 206, a convex side 232 nearest the convex side wall 210 of the airfoil 206, a leading edge side 234 nearest the leading edge 212 of the airfoil 206, and a trailing edge side 236 nearest the trailing edge 214 of the airfoil 206, as shown in FIG. 4.

According to embodiments of the invention, in the concave side 230 of the platform 204, proximate the trailing edge 214, a relief hole 240 may be located. Relief hole 240 may be formed by any known hole formation, creation, or enhancement technique. For example, the relief hole 240 may be machined into the platform with a drill press, shape tube electrochemical machining, electro chemical drilling, or electrical discharge machining Alternatively, the relief hole 240 may be etched or cast.

In an exemplary embodiment, the relief hole 240 may be a blind hole, i.e., it does not exit the platform 204, but may be any suitably sized and shaped opening or cavity. The relief hole 240 may be cylindrical in shape having a circular cross-section. However, as those of ordinary skill in the art will appreciate, the relief hole 240 can have other suitable geometric configurations.

In one exemplary embodiment, the relief hole 240 is disposed on the concave side 230 of platform 204 at the approximate midpoint of the thickness of platform 204, in line with the trailing edge 214. For example, the midpoint of the thickness of platform 204 may be located within the surface cross-sectional area of relief hole 240. The relief hole may have a centerline 242 that is aligned with a mean camber line 244 of airfoil 206 at the trailing edge 214, as shown in FIG. 4. (As would be understood by one of ordinary skill in the art, the mean camber line of an airfoil is a line drawn halfway between the upper surface 207 and lower surface 205 of the airfoil.) This may allow the relief hole 240 to align with stresses on the blade 200, causing the load path to move away from the root region 216. This may result in reduction in stress at the root trailing edge cooling channel 220*a*. In some embodiments, the relief hole 240 may have dimensions relatively small in comparison to the dimensions of the platform. While the relief hole 240 may have any suitable dimensions, desirable dimensions may include a surface diameter of less than or equal to approximately 75% of the platform thickness; a maximum depth of up to twice the surface diameter; and a consistent diameter being maintained throughout the entire depth. When the relief hole 240 is relatively small, it may have a much smaller effect on blade natural frequencies than would grooves which extend from one face of the platform to another face of the platform.

The thermal response for the blade 200 having the relief hole 240 may be basically unchanged when compared to the original configuration. The relief hole 240 may significantly reduce the maximum principal stress at the root trailing edge cooling channel 220*a*. The thermal mechanical fatigue ("TMF") life at trailing edge 214 also may increases significantly with the implementation of the relief hole 240. Stress near the relief hole 240 may be comparable and slightly lower than that at the trailing edge 214. In one representative case, the maximum principal stress was reduced 17% and the TMF life increased by approximately 150%. Therefore, the benefit of the relief hole 240 is believed to be substantial.

Figure 5:
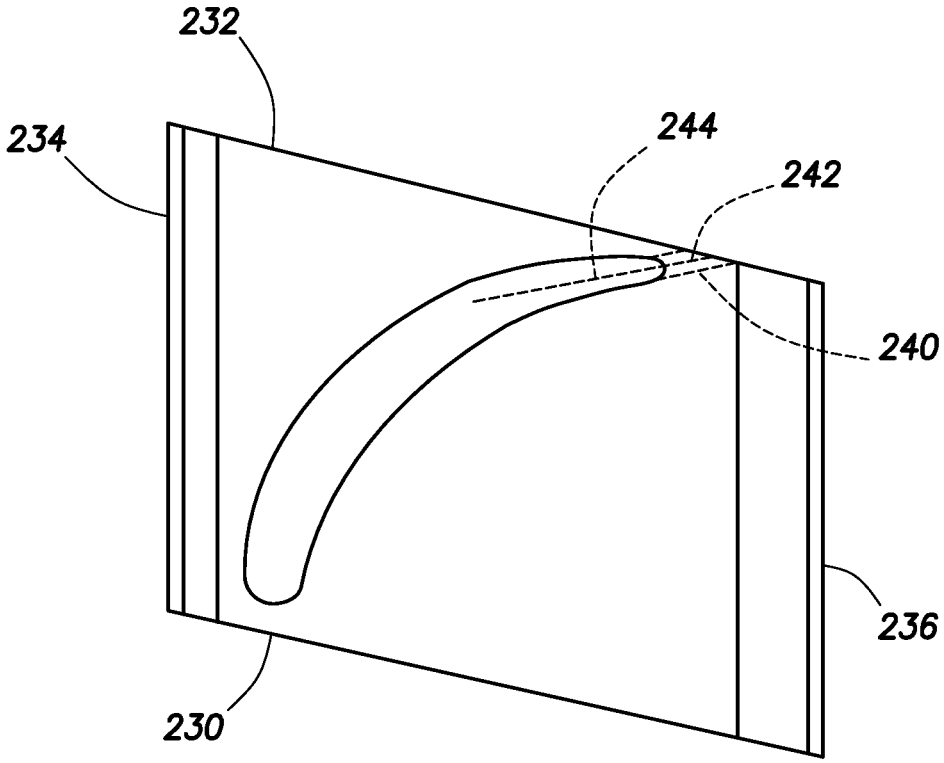
FIG. 5 is a cross-sectional view of the platform in accordance with embodiments of the present invention showing an alternate orientation of the relief hole.
Figure 6:
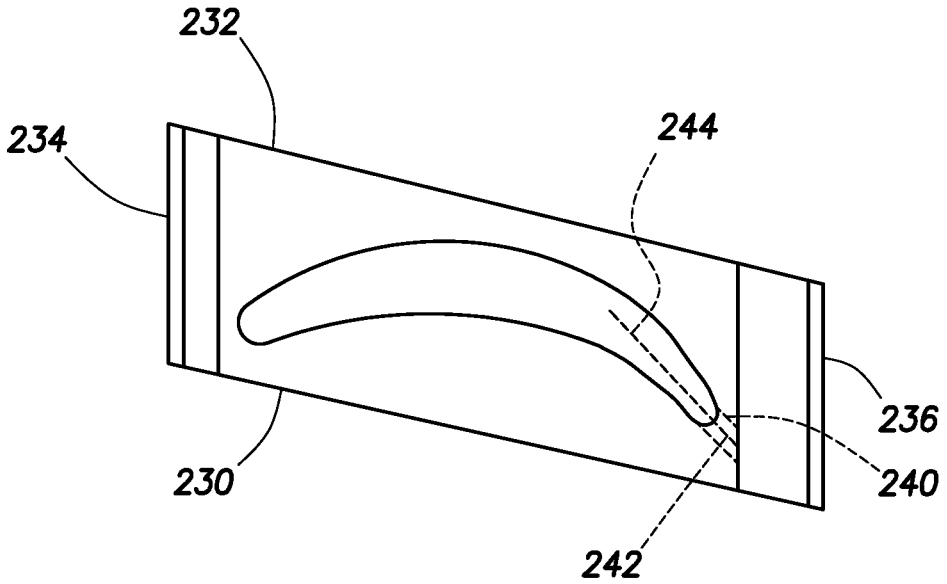
FIG. 6 is a cross-sectional view of the platform in accordance with embodiments of the present invention showing an alternate orientation of the relief hole.
Figure 7:
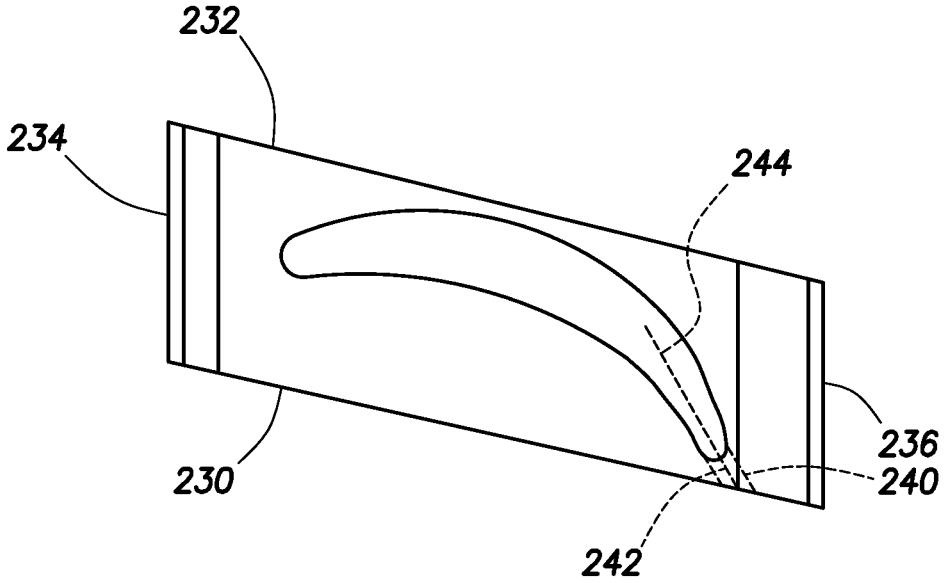
FIG. 7 is a cross-sectional view of the platform in accordance with embodiments of the present invention showing an alternate orientation of the relief hole.

While the relief hole 240 is shown in the concave side 230 of the platform 204, and aligned with the mean camber line 244, the relief hole 240 may be in the convex side 232 as shown in FIG. 5, or the trailing edge side 236 as shown in FIG. 6. Additionally, the relief hole 240 may be at a corner where the trailing edge side 236 and the convex side 232 intersect as shown in FIG. 7, or at any other suitable location. Additionally, the relief hole 240 may be situated such that it does not align with the mean camber line 244.

Another method, in accordance with embodiments of the present invention, involves removing the cracks 104 by forming a compound trailing edge cutback 824 which extends along the entire length of the trailing edge 214, i.e., from the root 216 of the blade to the tip 218. The cutback 824 may be formed by scribing a line and blending back to the scribed line. A non-destructive test may then be performed.

Figure 8:
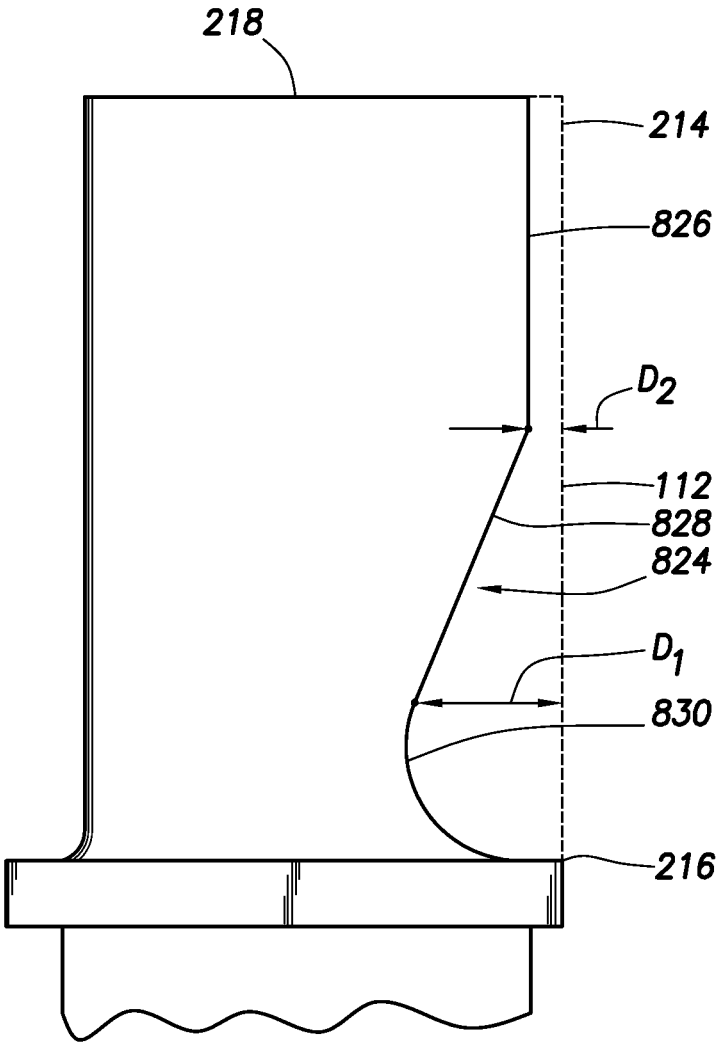
FIG. 8 is a cross-sectional view of a compound cutback in accordance with embodiments of the present invention.

As best seen in FIG. 8, in one exemplary embodiment, the cutback 824 has three discrete sections 826, 828, and 830. As those of ordinary skill in the art will appreciate, the cutback 824 may have other suitable shapes, which may enable the crack to be removed without significantly compromising the aerodynamic properties of the blade. Typically, very little, if any, of the material removed by the cutback 824 will be reinstated or replaced prior to returning turbine rotor blade 200 to service.

The first section 830 of the cutback 824 is arc-shaped and located near the root of the trailing edge 214. As those of ordinary skill in the art will appreciate, in order to substantially encompass the cracks 104, the depth of the cut of the first section 830 will be dependent on the depth of the cracks 104. In certain embodiments, the depth of the cut of the first section 830 is selected to encompass the entirety of cracks 104. In other embodiments, the depth of the cut of the first section 830 is selected to encompass 90% of the cracks 104. In one exemplary embodiment, the radius of the arc of first section 830 is approximately 10 mm (approximately 0.394").

The second section 828 of the cutback 824 is linear and has a generally non-zero slope. The second section 828 extends from the first section 830 to an intermediate span of the blade, which may be the approximate mid-span (halfway between the root 216 and the tip 218) of the blade. The depth of the cut which forms the second section 828 will be dependent upon the depth of the cut of the first section 830, which depends upon the depth of the cracks 104. In one exemplary embodiment, the depth (D1) of the second section 828 of the cutback 824 is approximately 15 mm (approximately 0.59") at the meeting with the first section 830, and the depth (D2) at the mid-span is approximately 2 mm (approximately 0.079").

The third section 826 of the cutback 824 is also linear and has a generally zero slope. The third section 826 extends from the second section 282 to the tip 218. The depth of the cut which forms the third section 826 will be dependent upon the depth of the cut of the second section 828. In one exemplary embodiment, the depth (D2) of the third section 826 of the cutback 824 is approximately 2 mm (approximately 0.079") along its entire length, i.e., it has a uniform depth.

The thermal response for the blade 200 having the compound trailing edge cutback 824 may be basically unchanged when compared to the original configuration. While the root trailing edge cooling channel 220*a* is still most susceptible to TMF and creep damage, the maximum principal stress associated with the trailing edge cutback modification only increases about 10%. The corresponding TMF life would probably be reduced approximately 65%, relative to the TMF life of the original design without the compound trailing edge cutback 824. The increase of stress is tolerable considering the maximum depth of the compound trailing edge cutback 824 near the root region 216. If all traces of original cracking 104 are absent from the root trailing edge cooling channel 220*a*, it may result in the restoration of a useful period of service life to the blade 200. It is likely that the compound cutback 824 will be more effective when the blade 200 operates on frequently cycled machines where the contribution of creep damage is less predominant than would be expected for base load machines.

Figure 9:
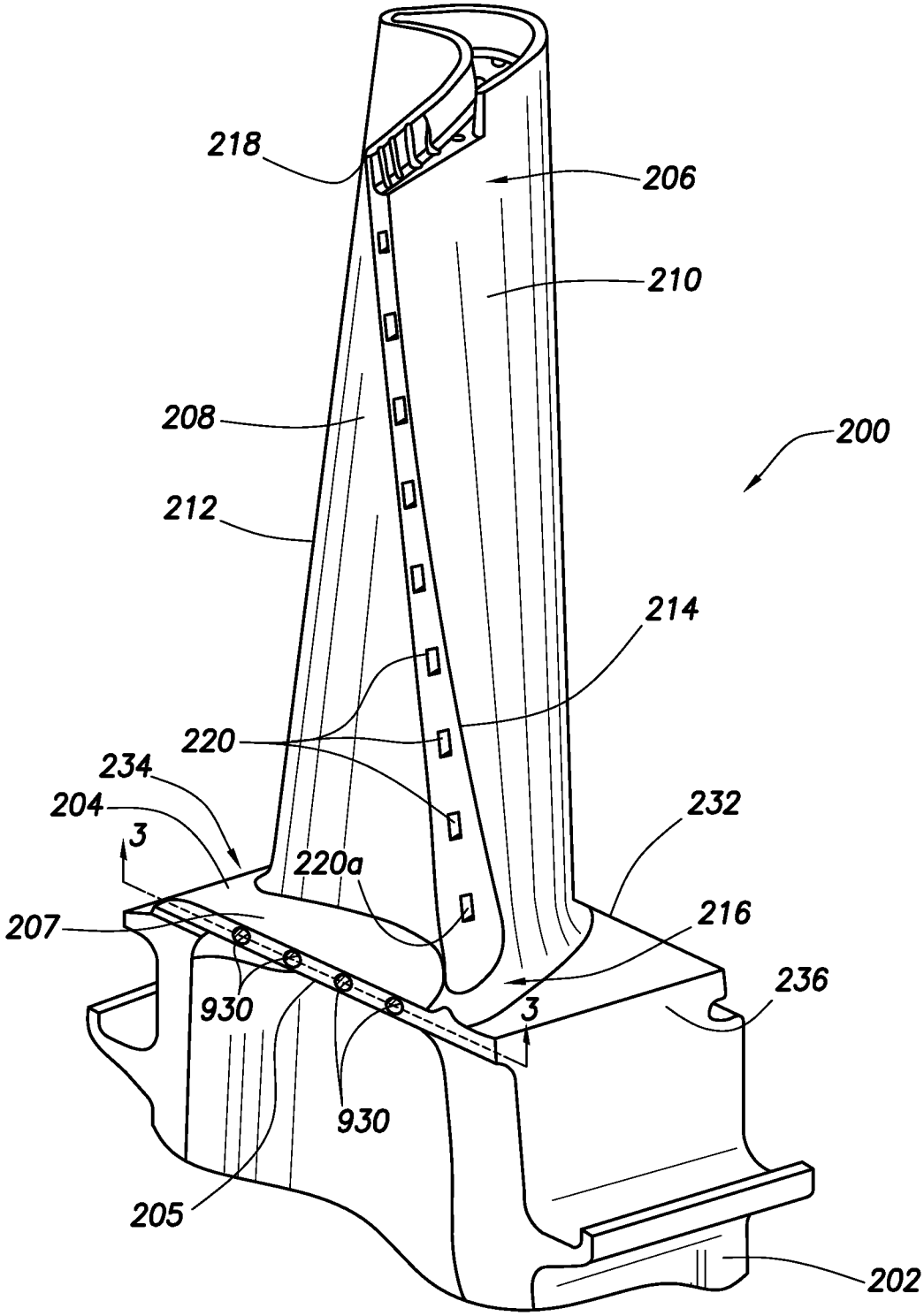
FIG. 9 is a perspective view of a turbine rotor blade in accordance with embodiments of the present invention having a plurality of cooling holes formed in its platform.

In accordance with some embodiments of the present invention and as illustrated in FIG. 9, the platform 204 may have a plurality of cooling holes 930 disposed therein on the concave side 230 of the platform 204. Typically, concave side 230 of platform 204 is the region of the platform that is most susceptible to high stresses, often resulting in cracking, delaminating of coating, and/or separation or breakage of blade base material. In one embodiment, four such cooling holes 930 may be located in the platform 204. The number of cooling holes may vary, depending, inter alia, on the dimensions of the platform 204 and the holes 930.

The platform cooling holes 930 may be formed by an electrical discharge machining process. Alternatively, the platform cooling holes 930 may be formed via shaped tube electrolytic machining process or electro-chemical drilling process or other similar machining process. The process utilized to form the cooling holes 930 may be selected to avoid removal of the thermal barrier coating ("TBC") on the turbine rotor blade. In one embodiment, the platform cooling holes 930 may be generally cylindrical in shape, with center axes generally parallel to the lower surface 205 and the upper surface 207 of the platform 204. The cross-section of a platform cooling hole 930 at an outside edge of the platform 204 may span approximately 50% of the platform thickness, or the platform cooling holes 930 may have a diameter of approximately 50% of the thickness of the platform 204. The platform cooling holes 930 may also be disposed at the approximate midpoint of the thickness of the platform 204, i.e., the centers of the cross-section of the platform cooling holes 930 at the outside edge of the platform 204 are aligned at the midpoint of the thickness of the platform so that an equal amount of platform material is left above and below the platform cooling holes 930.

Figure 10:
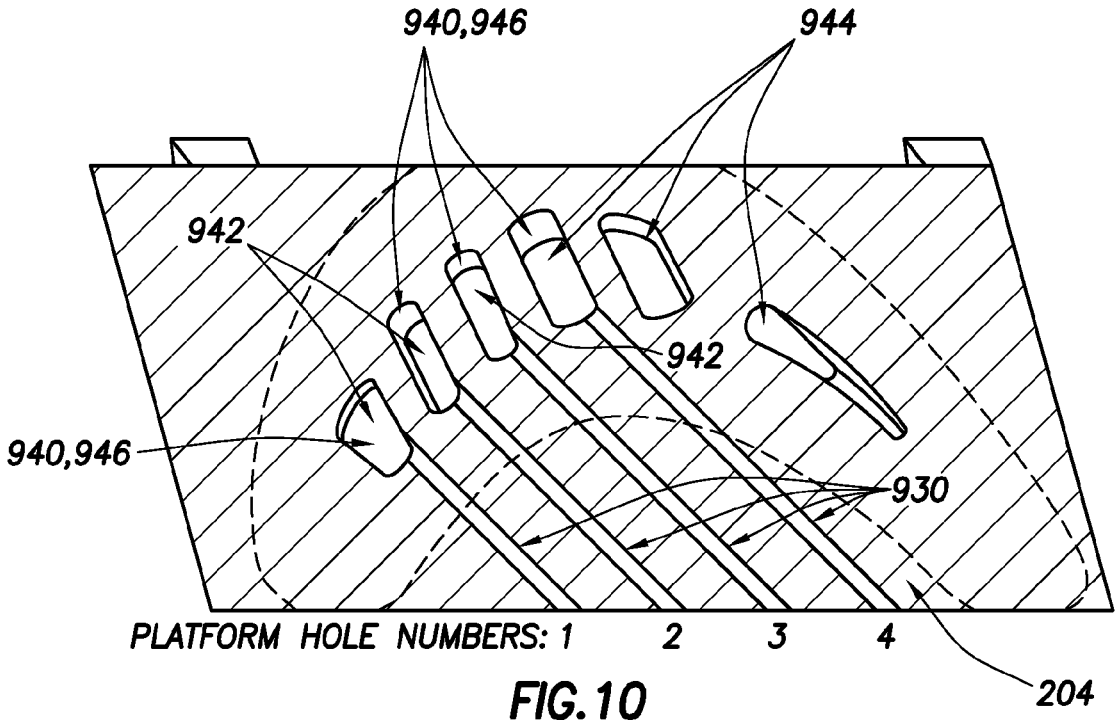
FIG. 10 is a cross-sectional view of the platform of the turbine rotor blade taken across line 3-3 shown in FIG. 9, illustrating the platform cooling holes of embodiments of the present invention communicating with the corresponding distinct cooling pathways of a serpentine cooling circuit.

In one embodiment, the center axes of the platform cooling holes 930 may be angled with respect to the outside edge of the platform 204, which is best seen in FIG. 10. The angle of the center axes of the platform cooling holes 930 need not necessarily be identical. The platform cooling holes 930 may intersect a cooling cavity or passage 940, which platform 204 shares with the airfoil 206, and which may be fed by cooling air from the compressor section of the turbine (not shown). In the embodiment shown in FIG. 10, the common cooling passage 940 may be defined by a pair of serpentine cooling circuits, namely, a leading serpentine cooling circuit 942 and a trailing serpentine cooling circuit 944. In turn, each of the serpentine cooling circuits may be defined by a plurality of generally parallel channels or pathways 946.

An example orientation and location of the serpentine cooling circuits is shown in cross section in FIG. 10. Each of the center axes of the platform cooling holes 930 may form an angle with the edge of the platform 204 which is approximately 45°. Each of the platform cooling holes 930 is illustrated as extending to, and communicating with, a distinct cooling pathway 946. Alternatively, some of the cooling holes 930 may be configured to extend to, and communicate with, a shared cooling pathway 946. The cooling air thus may flow from the compressor to the turbine rotor blade 200 first through a cavity in the shank 202 (not shown), then through the cooling pathways 946 of the serpentine cooling circuits 942, 944, and then through the platform cooling holes 930, before exiting the turbine rotor blade. As the cooling air flows through the platform cooling holes 930 it may cool the platform 204, thereby preventing delamination of the TBC, formation of cracks, and, worse, breakage and separation of the platform in that region altogether.

Figure 11:
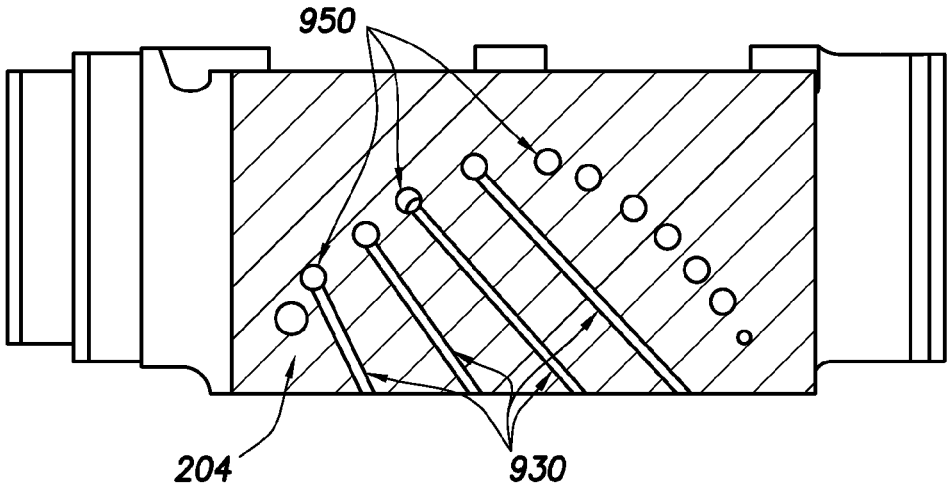
FIG. 11 is a cross-sectional view of the platform of the turbine rotor blade taken across the same line 3-3 shown in FIG. 9, illustrating the platform cooling holes of embodiments of the present invention communicating with a corresponding plurality of generally parallel cooling veins formed in the airfoil and platform.

In another embodiment (shown in FIG. 11), the center axes of the platform cooling holes 930 may be at an angle and orientation within the thickness of the platform, while extending to, and communicating with, a corresponding plurality of generally parallel, vertical cooling veins 950 in the platform. In other words, the cooling passage 940 in FIG. 11 may be a plurality of discrete generally parallel cooling veins 950. The cooling veins 950 may be formed by a number of processes, but usually are formed by a shaped tube electrolytic machining drilling process. The cooling veins 950 may intersect a cavity (not shown) in the shank 202 of the turbine rotor blade 200, which is fed by cooling air from the compressor (also not shown). As those of ordinary skill in the art will appreciate, a different number of platform cooling holes 930 may be implemented, such platform cooling holes 930 may be at a different angle than that disclosed herein, and such platform cooling holes 930 may be oriented at a different location within the thickness of the platform.

Without limiting the invention to a particular theory or mechanism of action, it is nevertheless currently believed that the overall cooling flow may increase and the internal cooling flow may be re-distributed as a consequence of adding the platform cooling holes 930. Table I lists the cooling mass flow which may occur as a result of adding the platform cooling holes 930 to an example first stage turbine rotor blade with serpentine cooling passages.

TABLE I

Comparison of Cooling Flow Rate

| | Prior Art Blade | Blade with Platform Cooling Holes | Difference |
|---|---|---|---|
| Leading Serpentine ($lb_m$/hr) | 453 | 456 | +0.7% |
| Trailing Serpentine ($lb_m$/hr) | 512 | 518 | +1.2% |
| Total ($lb_m$/hr) | 965 | 974 | +0.9% |

As shown in the table, the cooling flow in the leading serpentine cooling circuit may be ~0.7% more than the prior art blade configuration, and the cooling flow in the trailing serpentine cooling circuit may increase by ~1.2%. The total cooling flow may increase by ~0.9% with the drilling of four platform cooling holes 930. The cooling flow of the leading three platform cooling holes 930 may be 6.1, 5.8, and 6.5 pound mass per hour ($lb_m$/hr), respectively. For the 4th platform cooling hole 930, which branches from the trailing serpentine passage, the flow rate may be 6.1 $lb_m$/hr. The total platform cooling flow may be 24.4 $lb_m$/hr, or about 2.5% of total cooling flow available to the bucket.

Figure 12:
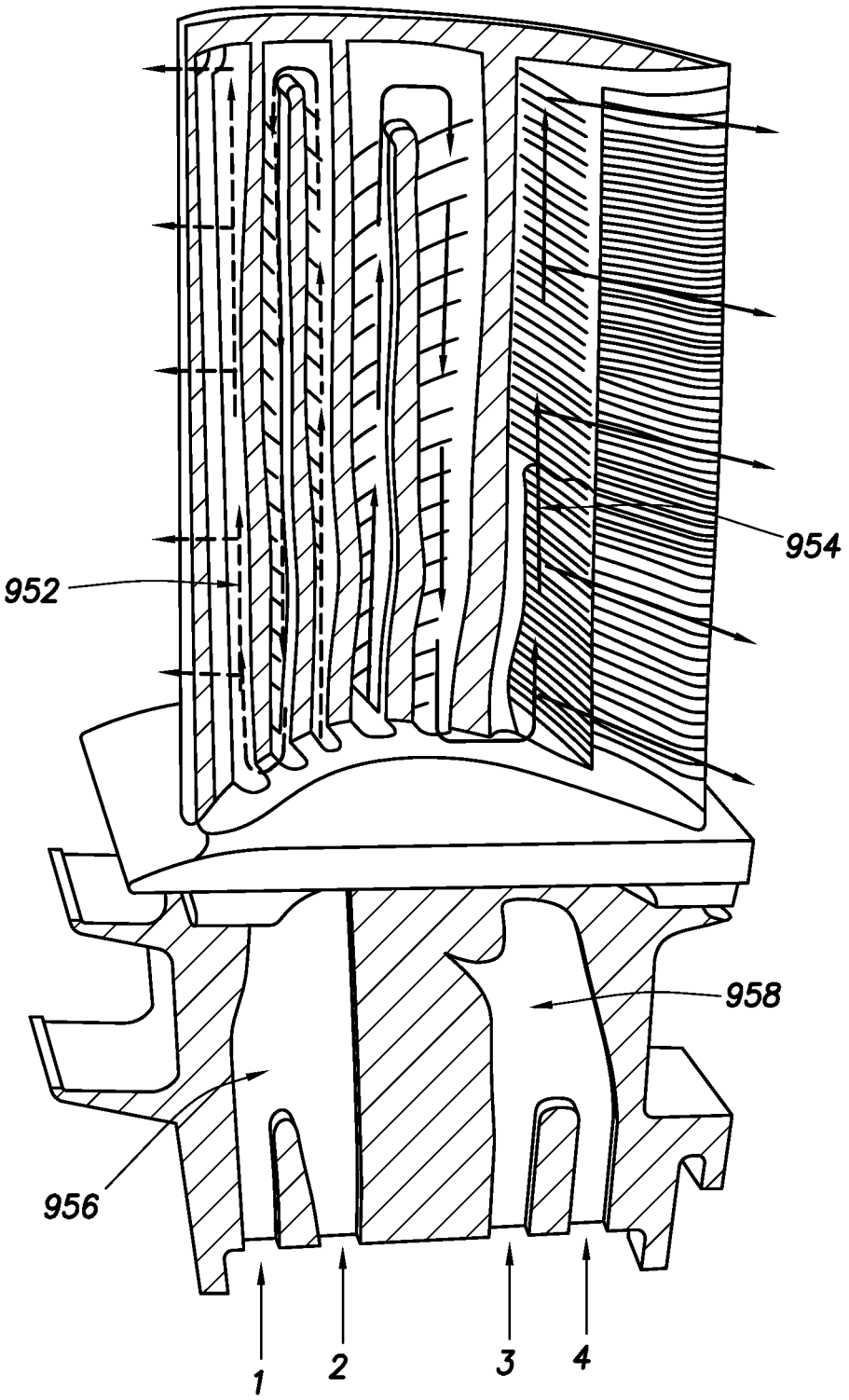
FIG. 12 is a cross-sectional view of a turbine rotor blade with two separate serpentine cooling passages in the airfoil, according to various embodiments of the present invention.

FIG. 12 shows an example of separate serpentine cooling passages in the airfoil. The leading edge serpentine cooling circuit 952 may cool the leading, front half of the blade, and may receive its cooling air from inlets 1 and 2, which may be located at the base of the blade and lead into cavity 956. The trailing edge serpentine cooling system 954 may cool the trailing, back half of the blade, and may receive its cooling air from inlets 3 and 4, which may be located at the base of the blade and lead into cavity 958.

Figure 13A:
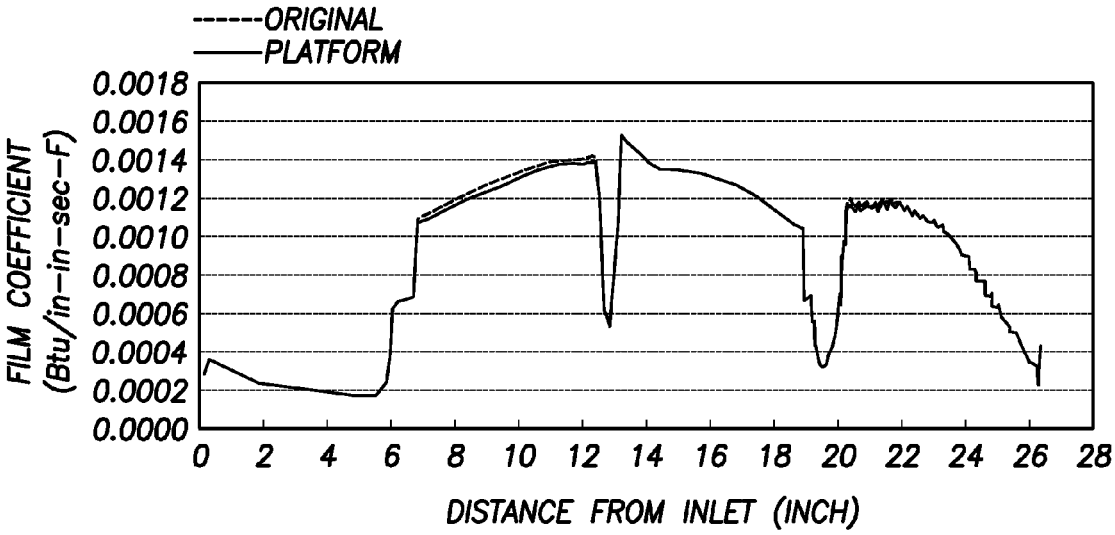
FIGS. 13A and 13B are plots of the distribution of heat transfer coefficient (or film coefficient) along the leading and trailing serpentine cooling circuits (shown in FIG. 12), respectively, as a function of the distance from the air inlets at the base of the blades, to each corresponding (leading or trailing) cooling circuit, according to various embodiments of the present invention.
Figure 13B:
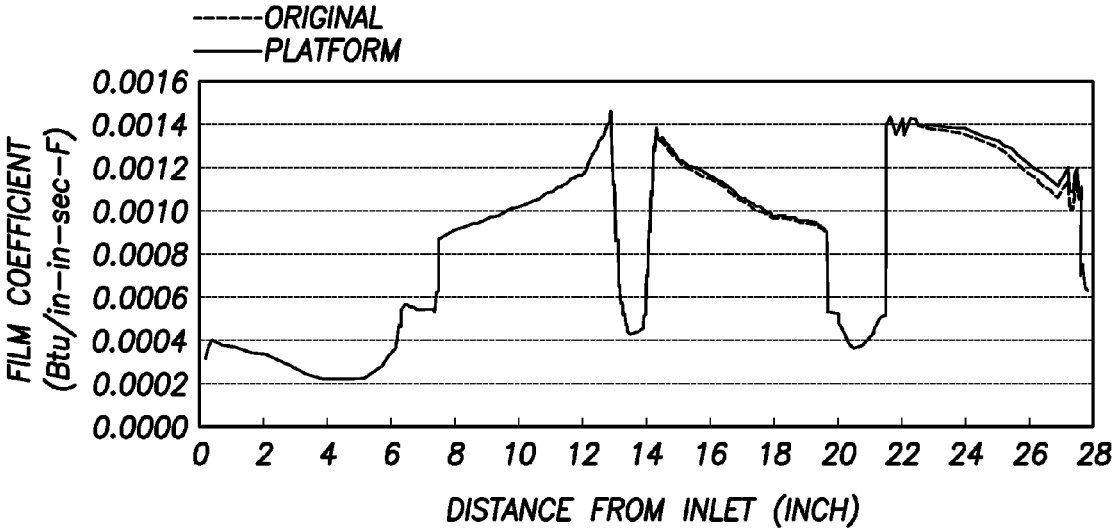
Figure 14A:
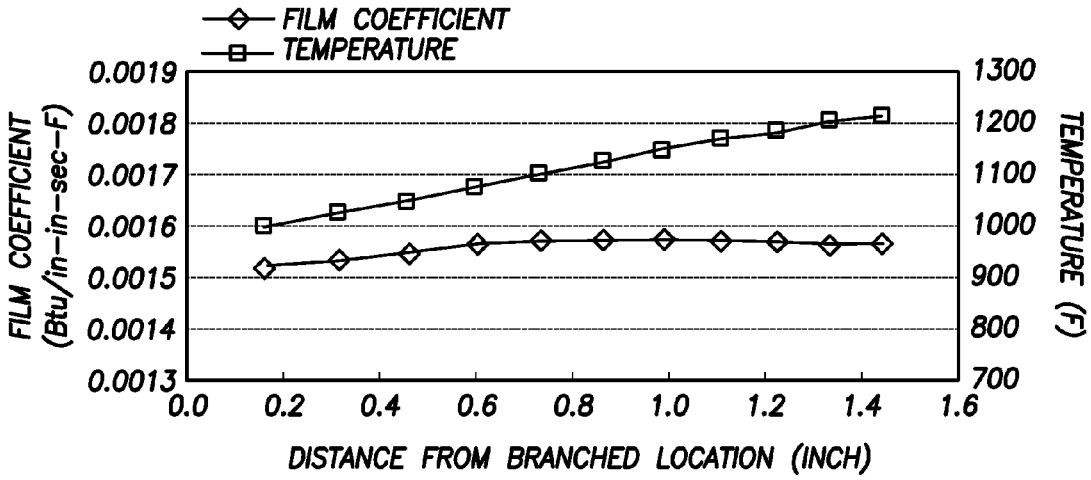
FIGS. 14A-14D are plots of the film coefficient and cooling air temperature along the length of the platform cooling holes as shown in FIG. 10, according to various embodiments of the present invention. The film coefficients and temperatures are shown as a function of distance from the point where the platform cooling holes join the serpentine cooling circuits for each of the four platform cooling holes.
Figure 14B:
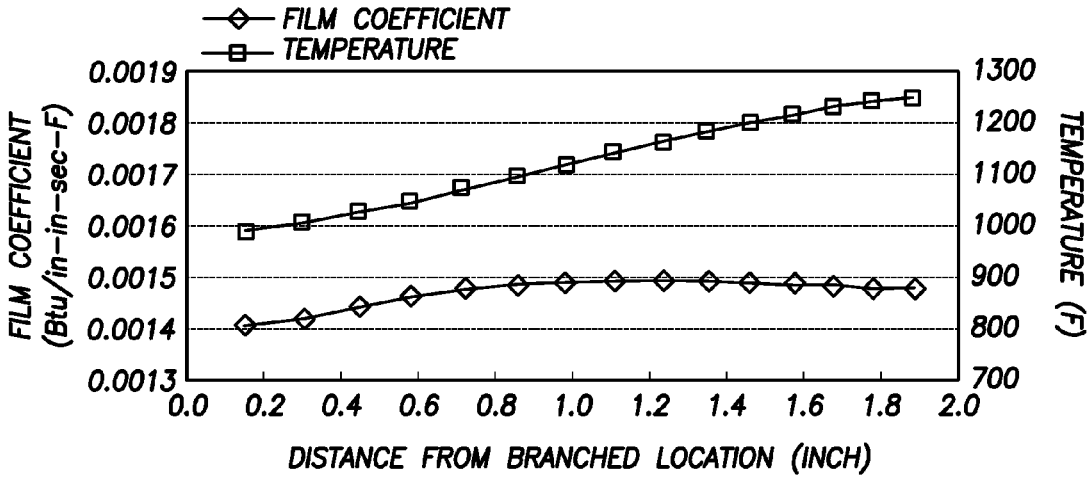
Figure 14C:
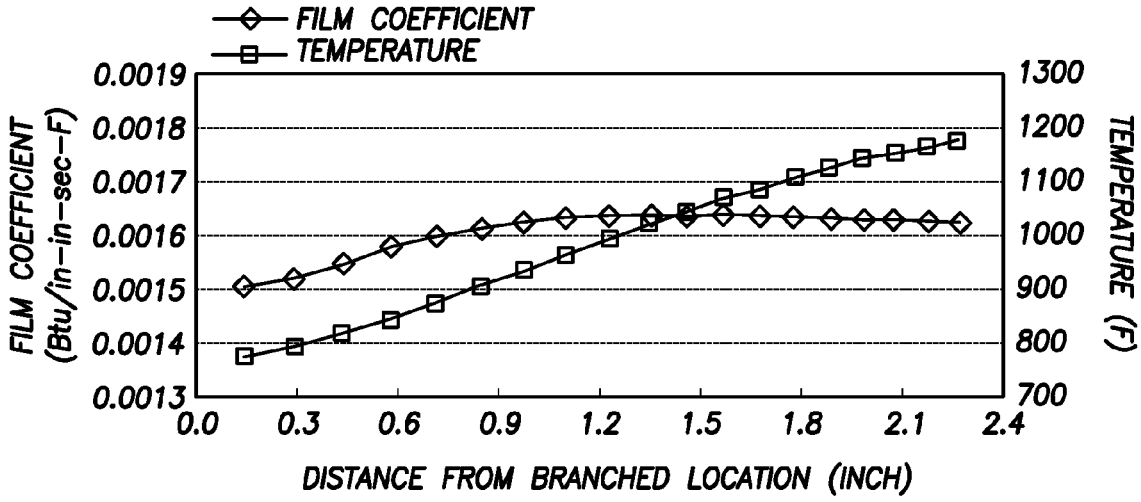
Figure 14D:
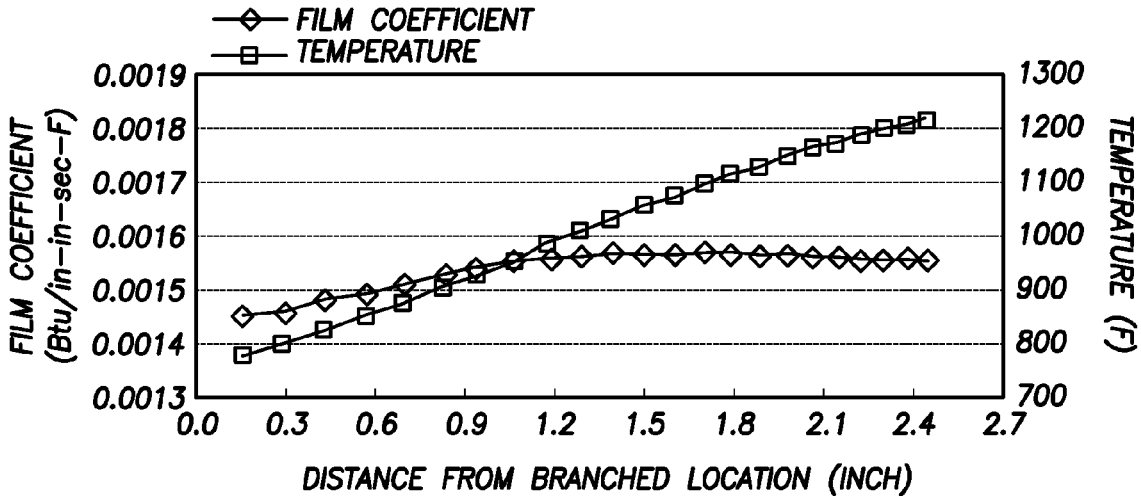

FIGS. 13A and 13B show the distribution of heat transfer coefficient (or film coefficient) along the leading and trailing serpentine circuits, respectively, according to one embodiment of the invention. It can be seen that drilling four platform cooling holes 930 may have a minimal impact on the original cooling of the main internal flow. Computed cooling flow parameters for each platform cooling hole for one embodiment are shown in FIGS. 14A-14D, respectively.

Figure 15B:
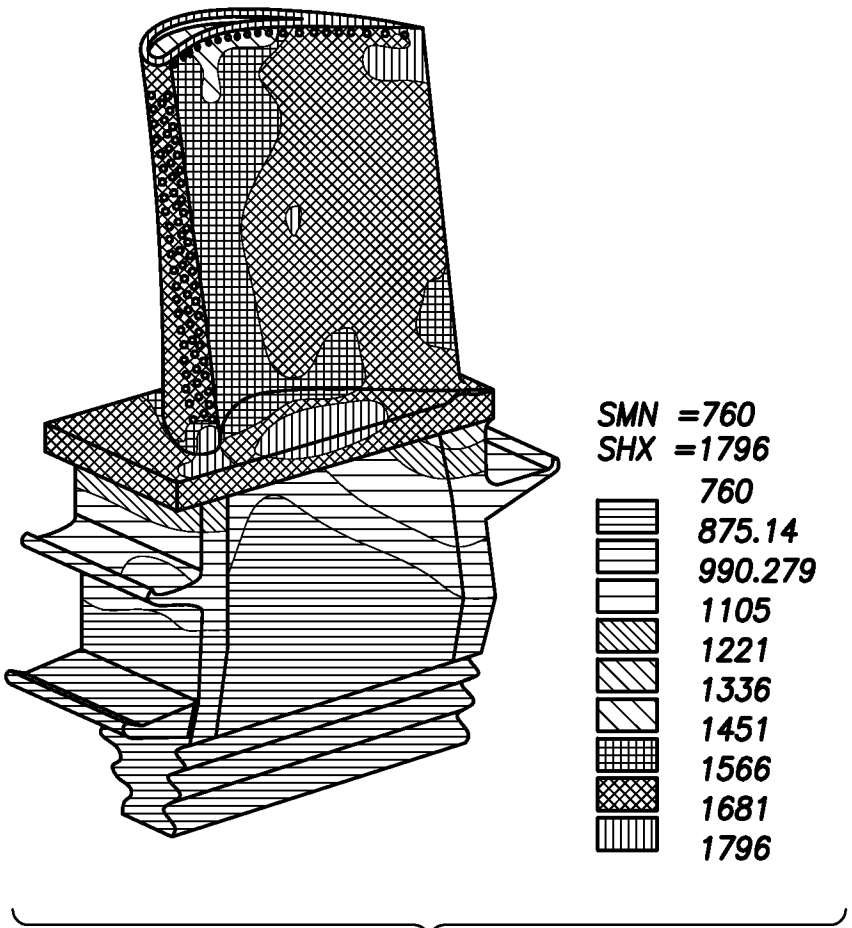
FIGS. 15A and 15B are perspective views of the turbine rotor blade with (FIG. 15A) and without (FIG. 15B) the platform cooling holes according to various embodiments of the present invention, respectively, illustrating the metal temperature distribution on the surface of the entire blade.
Figure 15A:
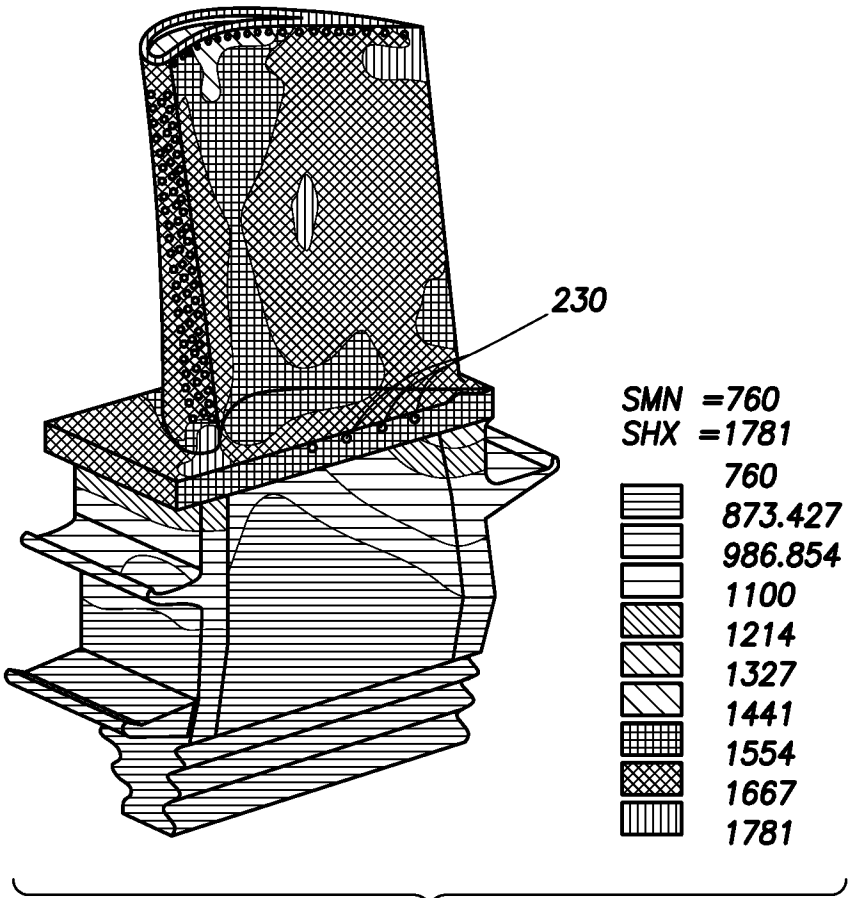
Figure 16B:
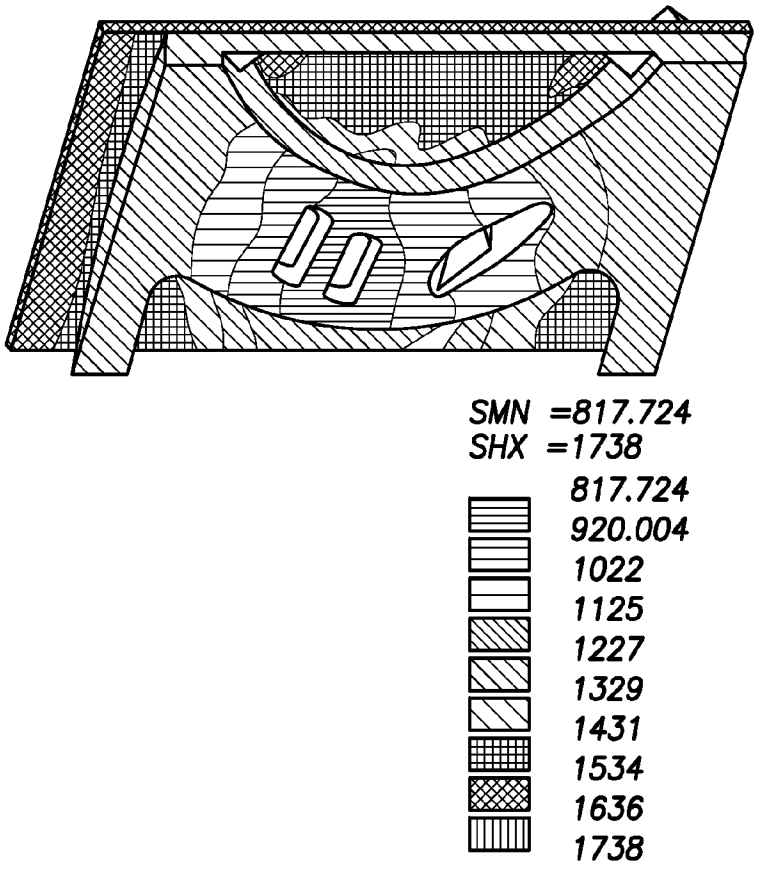
FIGS. 16A-16D are perspective views of the turbine rotor blade with (FIGS. 16A and 16B) and without (FIGS. 16C and 16D) the platform cooling holes according to various embodiments of the present invention, respectively, illustrating the temperature distributions in the region of these blades proximate the platform cooling holes.
Figure 16A:
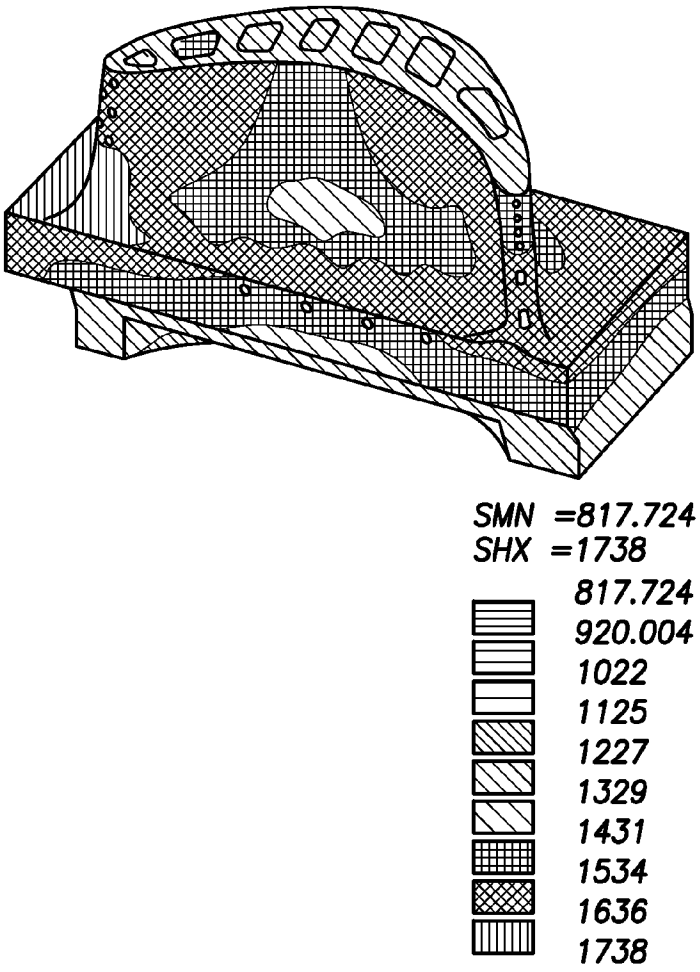
Figure 16D:
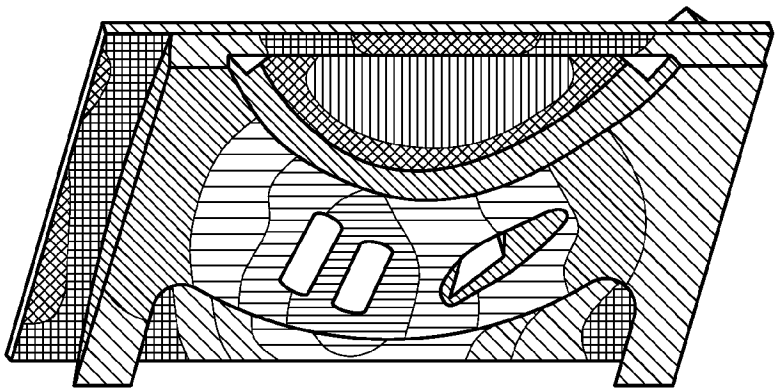
Figure 16C:
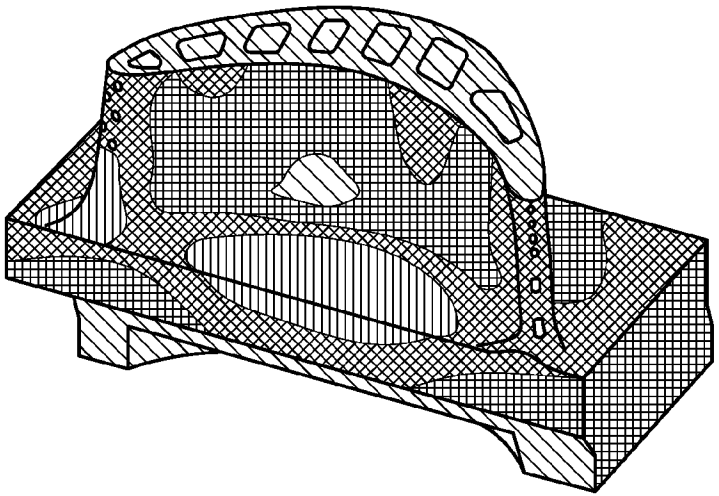

Resulting surface temperature distributions of a blade modified with platform cooling holes 930, according to one embodiment of the invention, and of a prior art blade are shown in FIGS. 15A and 15B, respectively. As indicated by the results of the cooling flow analysis, the thermal response in the airfoil above the platform may be basically unchanged when compared to the temperature distribution of the original design configuration. As a consequence of the insertion of four parallel platform cooling holes 930, a substantial reduction of temperature was predicted in the region encompassing the platform cooling holes 930. The peak temperature predicted on the pressure side of the platform was significantly reduced from approximately 1800° F. for the original design to 1600° F. for the modified platform, e.g. a drop of about 200° F. This is illustrated in FIGS. 16A-16D. As indicated by this drop, the platform cooling holes 930 may be effective as they extract fresh coolant air from the serpentine cooling circuit and provide maximum coverage possible over the pressure side region of the platform.

Figure 17A:
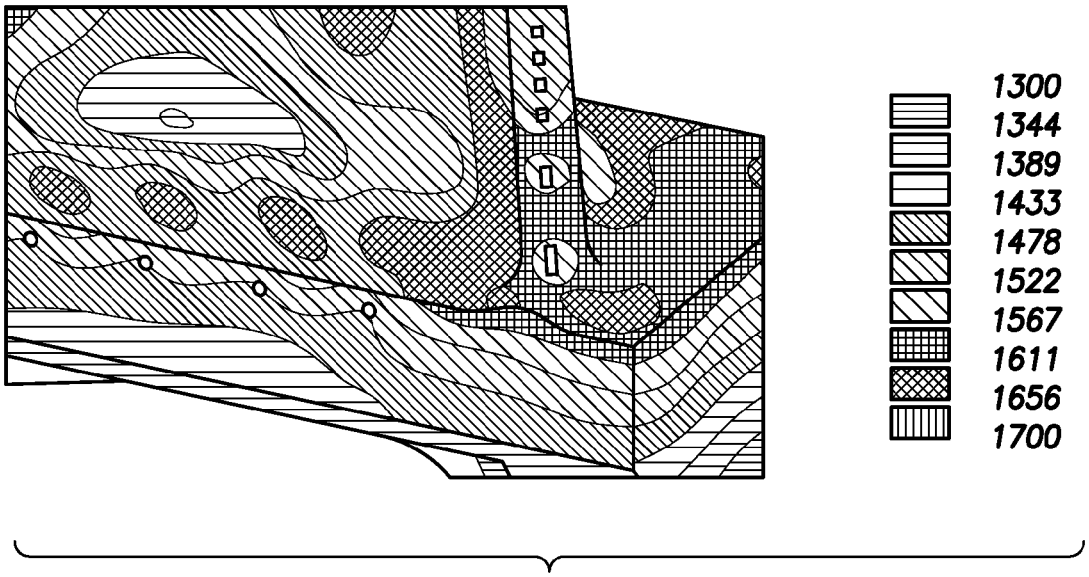
FIGS. 17A and 17B are perspective views of the turbine rotor blade with (FIG. 17A) and without (FIG. 17B) the platform cooling holes according to various embodiments of the present invention, respectively, illustrating the temperature distribution in the region of the blade proximate the juncture of the platform and trailing edge lowermost cooling hole.
Figure 17B:
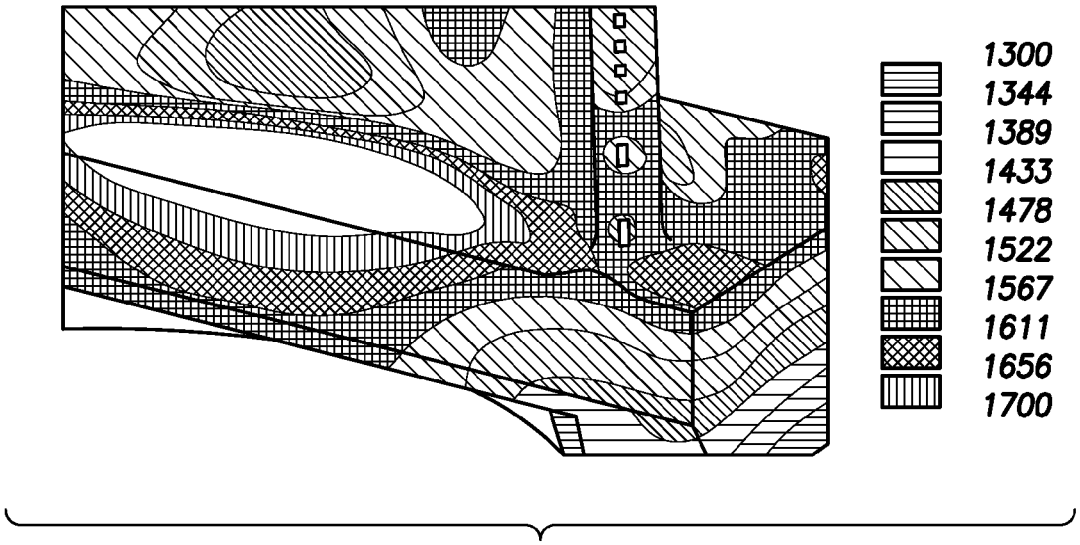
Figure 18A:
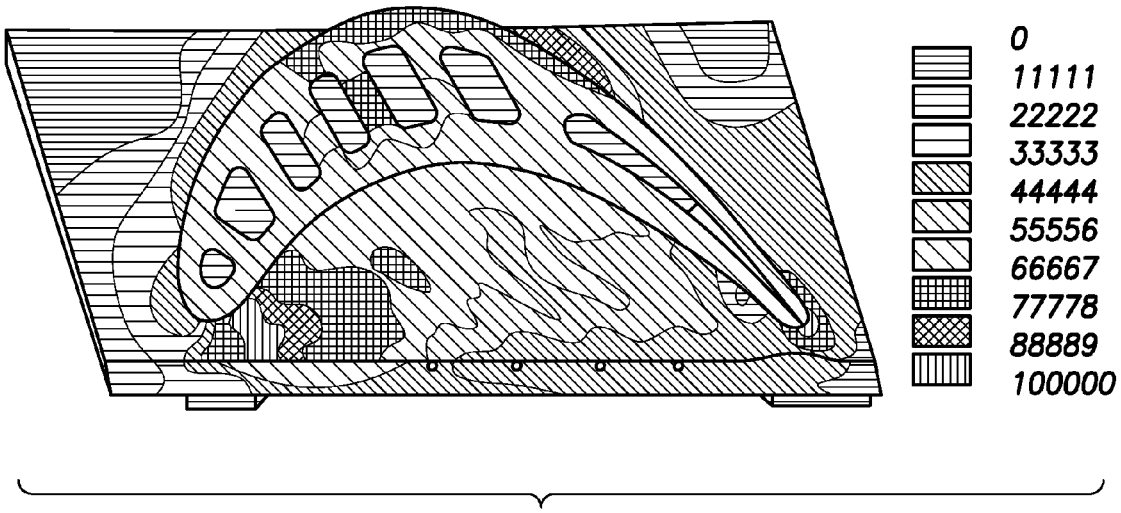
FIGS. 18A-18D are perspective views of the turbine rotor blade with (FIGS. 18A and 18B) and without (FIGS. 18C and 18D) the platform cooling holes according to various embodiments of the present invention, respectively, illustrating the equivalent stress distributions in the platform region.
Figure 18B:
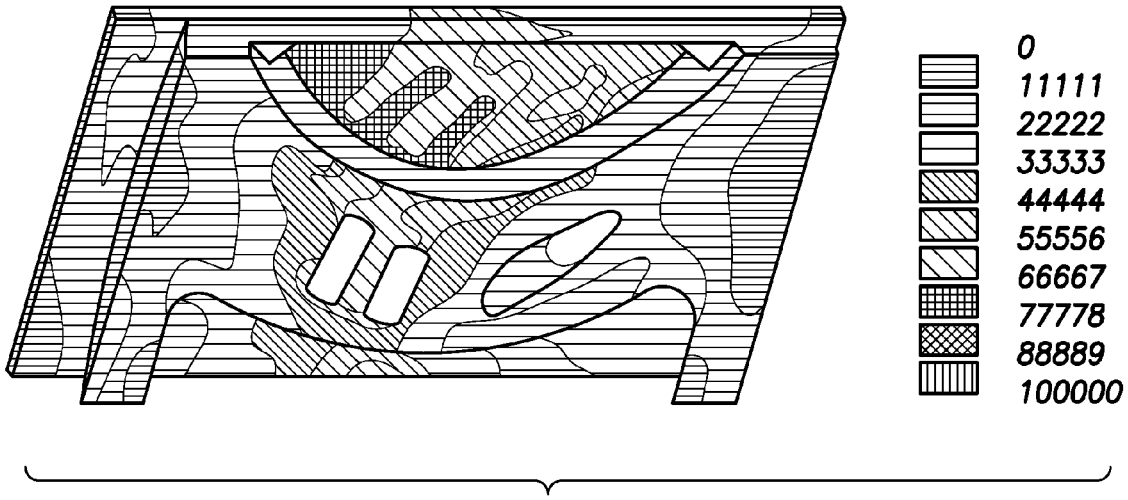
Figure 18C:
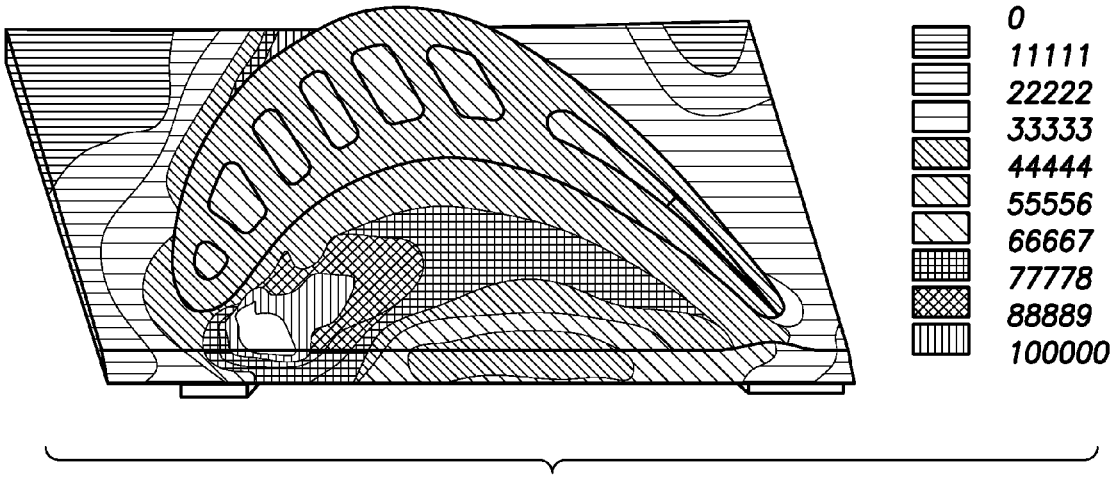
Figure 18D:
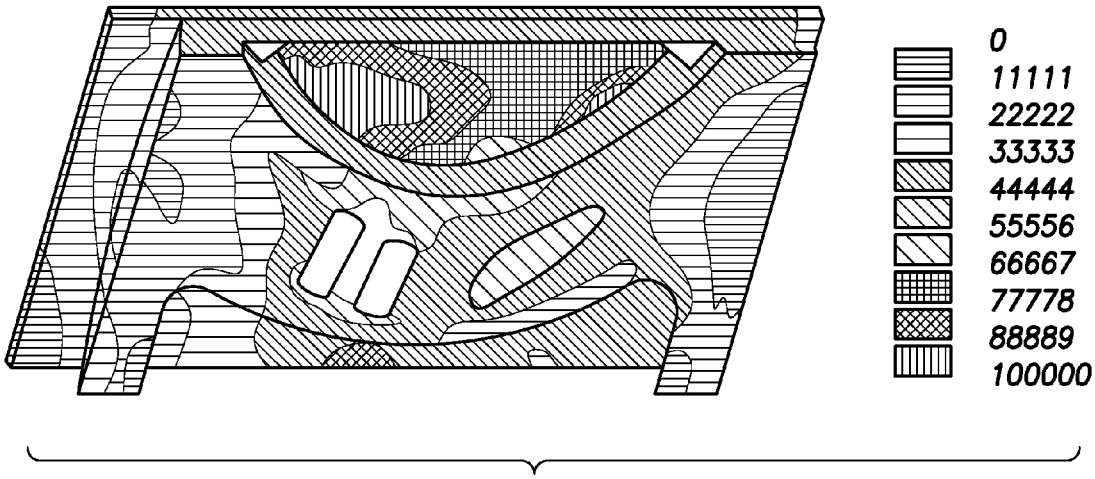
Figure 19A:
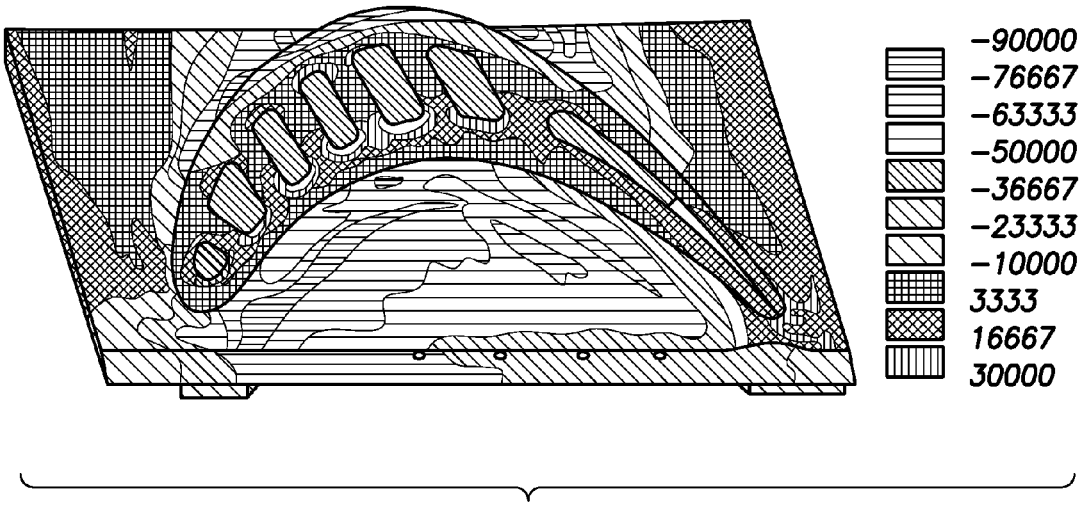
FIGS. 19A-19D are perspective views of the turbine rotor blade with (FIGS. 19A and 19B) and without (FIGS. 19C and 19D) the platform cooling holes according to various embodiments of the present invention, respectively, illustrating the axial stress distributions in the platform region.
Figure 19B:
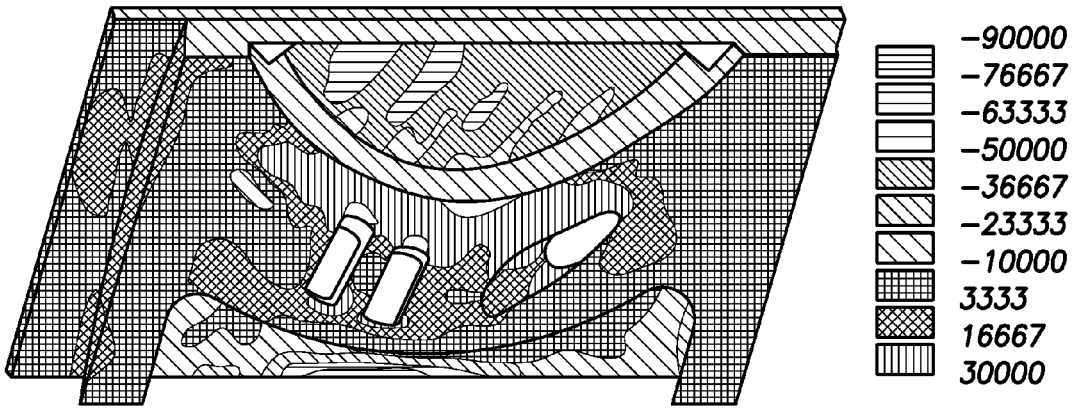
Figure 19C:
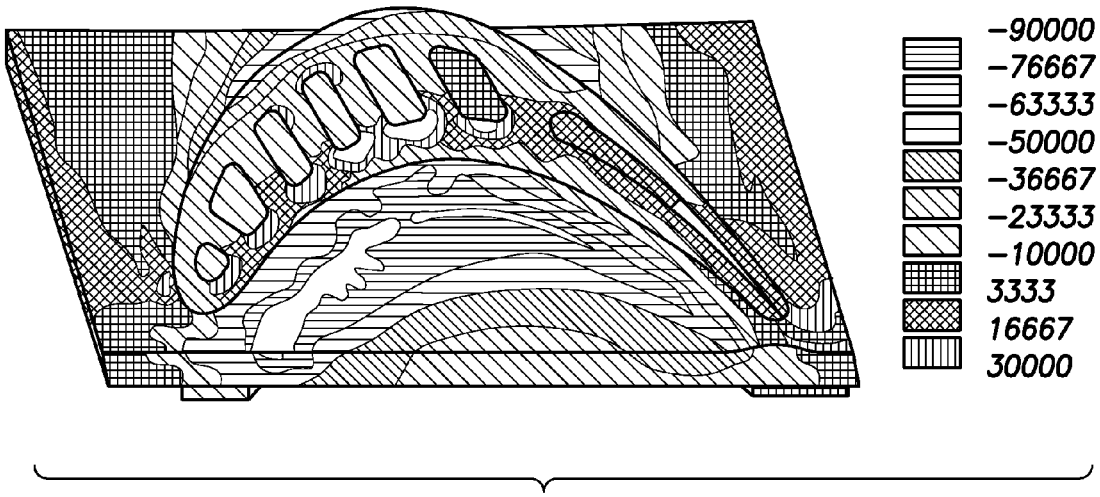
Figure 19D:
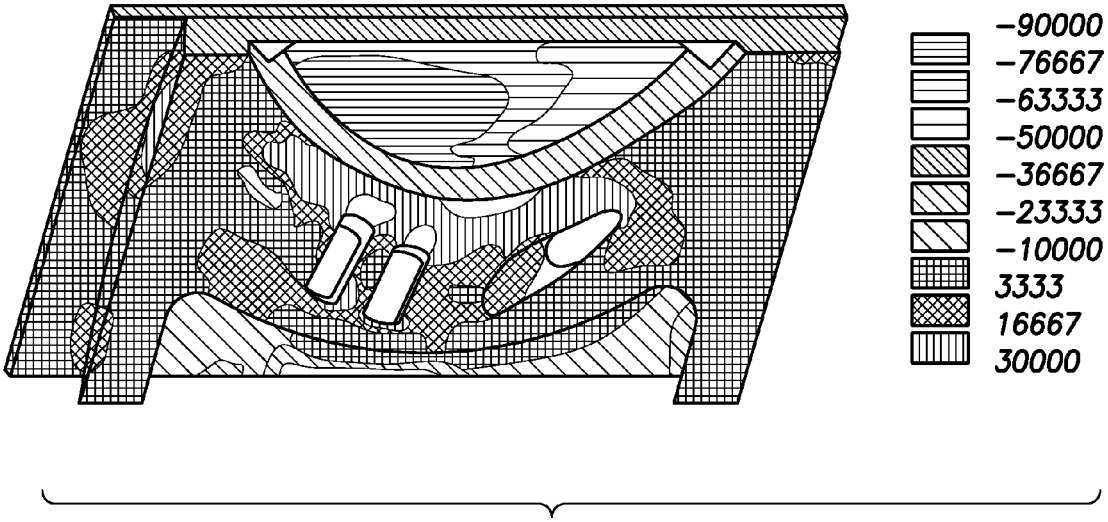

Further examining these results indicates at least two benefits of the proposed platform cooling strategy. Through the additional convective cooling and conduction, the gross reduction of the temperature in the platform region may favorably lower the temperature gradients near the juncture of platform and trailing edge lower-most cooling channel, which may be particularly susceptible to cracking, as indicated in FIGS. 17A and 17B. Temperatures near the trailing edge lowermost cooling channel may be lowered by approximately 10° F.

Equivalent and axial stress distributions of the blade modified with platform cooling, according to one embodiment of the invention, are plotted in FIGS. 18A-18D and FIGS. 19A-19D, respectively. In the prior art turbine rotor blades, there may be large, compressive stresses induced by platform curling, due, in part, to the temperature gradients across the platform 204 and airfoil/shank region (under steady load). The excessive compressive stress at base load may indicate a potential for substantial damage resulting from the out-of-phase TMF that may occur from each start-stop cycle. As shown in FIGS. 18A-18D and FIGS. 19A-19D, overall stress levels on the pressure side of the platform 204 may be reduced by about 10-30%. At the free edge, near the exit of the platform cooling holes 930, the critical minimum principal stress may be reduced from about 93 kilo-pound per square inch ("ksi") to about 62 ksi as a result of platform cooling modification. In the mid-span, the critical minimum principal stress may decrease from about 111 ksi to about 100 ksi. This relatively mild stress may be localized and attributed to the thermal gradient across the platform cooling hole 930. Nevertheless, lowering the metal temperature by about 150° F.-200° F. may significantly enhance the associated fatigue properties and, hence, increase the corresponding TMF life. TMF life may improve by as much as 200% by taking into consideration the fatigue property benefits resulting from the calculated temperature improvement (as indicated in Table II). In addition, with a much lower stress predicted at the free edge near trailing edge of the blade, the fatigue crack propagation life may improve substantially comparing to the original design.

TABLE II

| Comparison of Stress Results in the Platform | | | |
|---|---|---|---|
| | Critical Min. Principal Stress (ksi) | % Change of Stress | Estimated % Change of TMF Life |
| Prior Art Blade | 111 | 0% | 0% |
| Blade with Platform Cooling Holes | 100 | −10% | +200%* |

*taking into account the temperature effect on TMF property

Figure 20A:
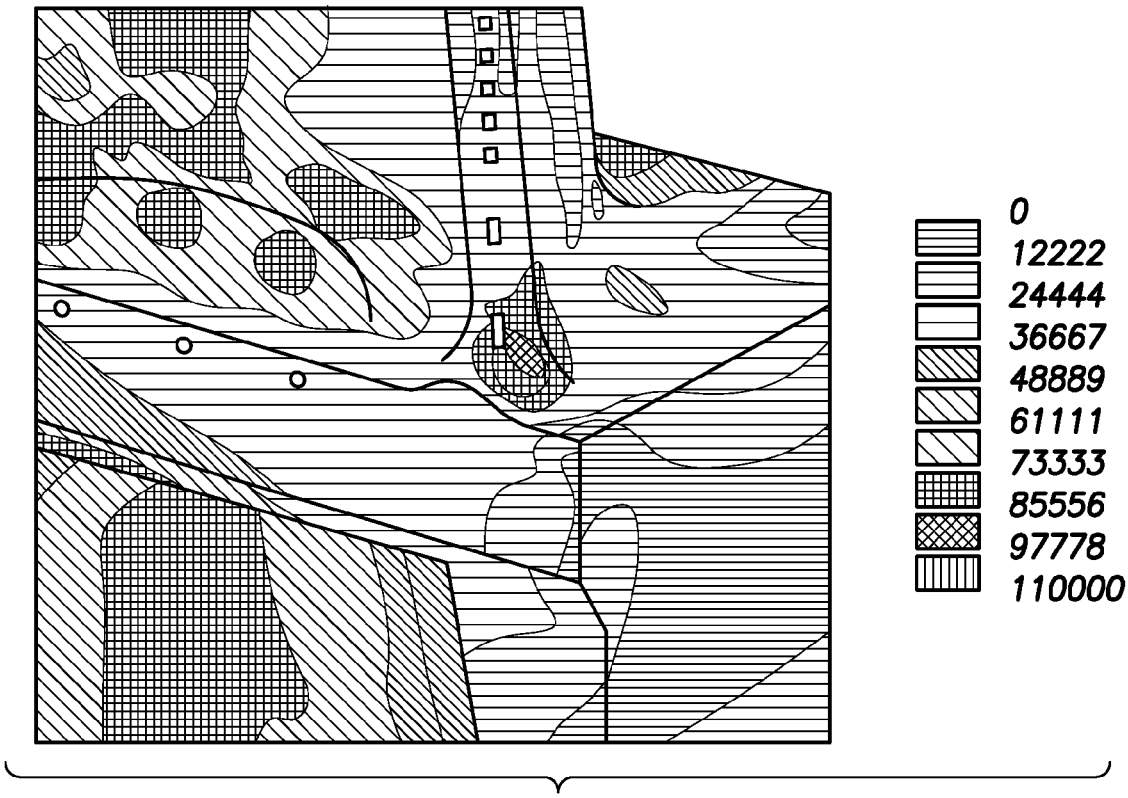
FIGS. 20A and 20B are perspective views of the turbine rotor blade with (FIG. 20A) and without (FIG. 20B) the platform cooling holes according to various embodiments of the present invention, respectively, illustrating the stress distributions proximate the juncture of the platform and lowermost, trailing edge cooling hole.
Figure 20B:
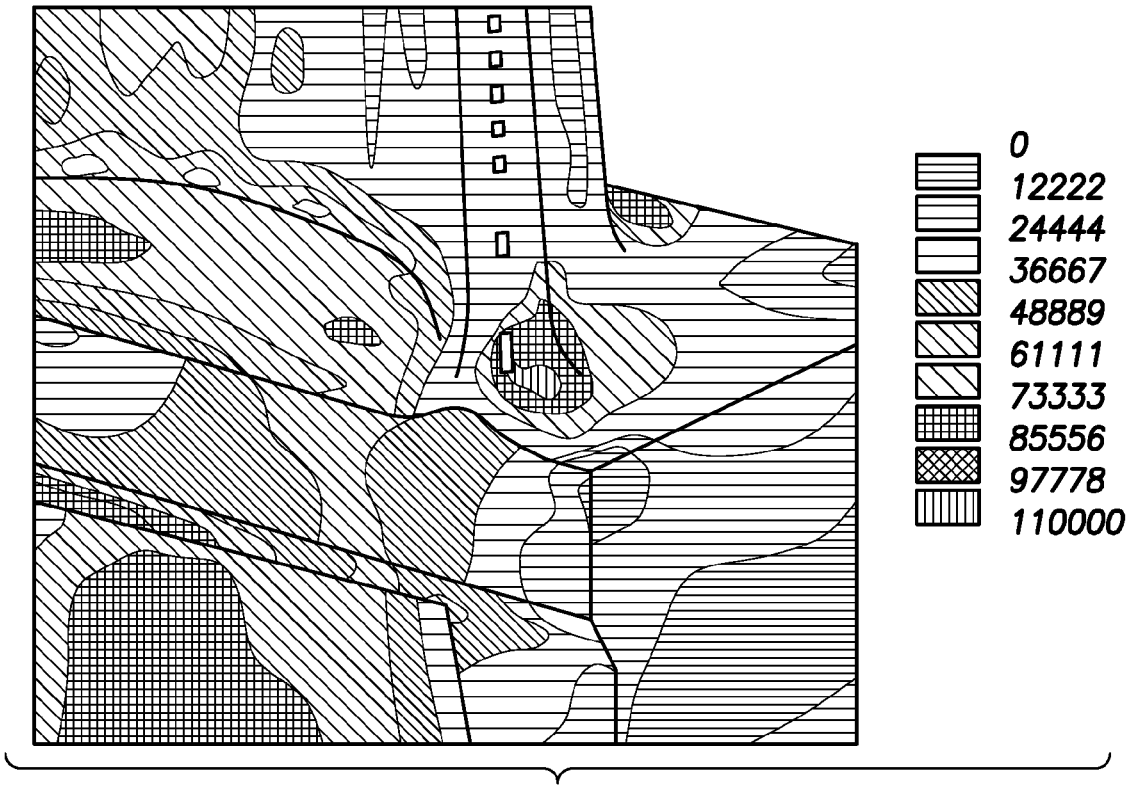

FIGS. 20A and 20B show a stress distribution in the lowermost cooling channel region after the platform cooling modification, according to one embodiment of the invention. As illustrated in the plot, the lower thermal gradient near the junction of airfoil trailing edge and platform may favorably reduce the stress at the critical location from about 83 ksi to about 76 ksi, or a drop of about 8% (Table III). The corresponding TMF life may increase by about 100% as a consequence of the platform cooling modification.

TABLE III

| Comparison of Stress Results in the Lowermost Cooling Hole | | | |
|---|---|---|---|
| | Critical Max. Principal Stress (ksi) | % Change of Stress | Estimated % Change of TMF Life |
| Prior Art Blade | 83 | 0% | 0% |
| Blade with Platform Cooling Holes | 76 | −8% | +100%* |

Thus, the platform cooling hole modifications of embodiments of the present invention may be effective in both reducing the temperatures and stresses in the cooled platform region. Moreover, they may provide additional benefits in lowering the thermal gradient near the juncture of platform and trailing edge, and consequentially reduce the stress at the trailing edge lowermost cooling channel. Based on a comparison to the results of the baseline analysis, these methods may be viable design modifications to be utilized in the course of forming a new turbine rotor blade and/or implemented during repair and refurbishment of blades.

Study results have indicated that unifying features of the present disclosure may result in synergistic effects. In a first exemplary unified embodiment, study results indicate exemplary synergistic effects resulting from a unified approach incorporating: (a) applying a TBC; (b) inserting a series of platform cooling holes; and (c) inserting a platform relief hole. This embodiment may be effective as a preventative measure for new buckets or applied to buckets with only a few accumulated cycles and hours. While a trailing edge cutback may be designed to remove damaged material in certain embodiments, certain embodiments of a platform relief hole may reduce the total stress level in the region of high stress. A platform relief hole may alleviate mechanical stress in the region by relaxing rigidity formed by the juncture of the airfoil and platform. Certain embodiments of a platform relief hole may be successfully implemented on turbine and/or compressor blades as a field repair and/or design modification.

In one example according to the first unified embodiment, a relief hole may be an approximately 0.325" blind hole that ends with an approximately 0.1625" radius. The relief hole may follow the trajectory of the trailing edge and have a depth of approximately or exactly 0.5". Aero-thermal analyses conducted on that example indicated an improved distribution of temperature. In the platform region, the temperature may be reduced from approximately 1800° F. for the prior art blade to approximately 1520° F. In the trailing edge lowermost cooling hole, the temperature reduction may be reduced from approximately 1550° F. to approximately 1460° F., primarily due to the application of TBC. In the trailing edge lowermost cooling hole, the temperature may be reduced from approximately 1550° F. to approximately 1460° F., or a drop about 90° F., primarily due to the application of TBC.

Study results indicated that, as compared to the prior art blade, the TMF life may improve by ~300% (as indicated by Table IV). With the first unified embodiment, the critical maximum principal stress in the trailing edge lowermost cooling hole region may be lowered from approximately 83 ksi (572 MPa) to approximately 65 ksi (448 MPa), or a reduction of about 22% (as indicated by Table V). The decrease in metal temperature of approximately 90° F.° may further assist in prolonging the originally estimated TMF life. Study results further indicated that TMF life in the trailing edge lowermost cooling hole may improve by as much as 280% when the gain in TMF strength resulting from the lower metal temperatures is taken into account. Thus, given these results, the potential benefits of the first unified embodiment may be substantial.

TABLE IV

| Comparison of Stress Results in the Platform - First Unified Embodiment Example | | | |
|---|---|---|---|
| | Critical Min. Principal Stress (ksi/MPa) | % Change of Stress | Estimated % Change of TMF Life |
| Prior Art Blade | 111/765 | 0% | 0% |
| First Unified Embodiment Example | 94/648 | −15% | +300%* |

*taking into account the temperature effect on TMF property

TABLE V

| Stress Results in the Lowermost Cooling Hole - First Unified Embodiment Example | | | |
|---|---|---|---|
| | Critical Max. Principal Stress (ksi/MPa) | % Change of Stress | Estimated % Change of TMF Life |
| Prior Art Blade | 83/572 | 0% | 0% |
| First Unified Embodiment Example | 65/448 | −22% | +280%* |

*taking into account the temperature effect on TMF property

In a second exemplary unified embodiment, study results indicate exemplary synergistic effects resulting from a unified approach incorporating: (a) applying a TBC; (b) inserting a series of platform cooling holes; (c) inserting a platform relief hole; and (d) a trailing edge cutback. In such an example, a trailing edge cutback may be added to the features of the first unified repair embodiment. A trailing edge cutback may be applied in a field repair to salvage buckets with cracking occurring at the lowermost cooling hole. The cutback strategy may substantially or completely remove the confined damage localized at the cooling hole. In certain embodiments, no portion of the original crack may remain in order to restore the structural integrity of the region. In such embodiments, the cutback strategy may be of sufficient depth to ensure the crack is eliminated, without reducing the strength of the structure to the degree that a new crack might form even more quickly. One example according to the second unified embodiment may include a uniform cutback of approximately 0.079" from airfoil tip to mid-span and a linear straight cut from mid-span to a maximum depth of 0.59" at the lowermost cooling hole. The example may include an approximately 0.394" radius in the transition between the lowermost cooling hole and the platform.

Results from aero-thermal analysis of that example indicate that the resulting temperature distributions are comparable to those in the first unified embodiment. The results indicate that temperature in the trailing edge lowermost cooling hole may be around 1470° F., slightly higher (about 10° F.) than that of the first unified embodiment. The resulting stress at the critical location in the platform may not be significantly different from that of first unified embodiment. The corresponding TMF may increase by about 300% over the original bucket (as indicated by Table VI). In the trailing edge lowermost cooling hole, the critical maximum principal stress may be approximately 78 ksi (538 MPa), about 6% lower than 83 ksi (572 MPa) for the original design. Taking into account the temperature advantage, the resulting TMF life may increase on the order of approximately 100%, relative to the TMF life of the prior art blade (as indicated in Table VII).

Based on the results of analysis, a two-step trailing edge cutback in conjunction with TBC, platform cooling holes, and a platform relief hole appears to be a very effective approach. Certain embodiments may result in the restoration of a substantially useful period of service life to the buckets, for example, if all traces of original cracks are removed in the lowermost cooling hole. Thus, the potential benefits of the second unified embodiment can be substantial.

TABLE VI

Comparison of Stress Results in the Platform - Second Unified Embodiment Example

| | Critical Min. Principal Stress (ksi/MPa) | % Change of Stress | Estimated % Change of TMF Life |
|---|---|---|---|
| Prior Art Blade | 111/765 | 0% | 0% |
| Second Unified Embodiment Example | 94/648 | −15% | +300%* |

*taking into account the temperature effect on TMF property

TABLE VII

Stress Results in the Lowermost Cooling Hole - Second Unified Embodiment Example

| | Critical Max. Principal Stress (ksi/MPa) | % Change of Stress | Estimated % Change of TMF Life |
|---|---|---|---|
| Prior Art Blade | 83/572 | 0% | 0% |
| Second Unified Embodiment Example | 78/538 | −6% | +100%* |

*taking into account the temperature effect on TMF property

The study results disclosed herein are not intended to limit the invention to a particular theory or mechanism of action. Moreover, synergistic effects may result from unifying other features of the present disclosure. For example, synergistic effects may result from unifying a blind relief hole feature and a trailing edge cutback feature. Likewise, synergistic effects may result from unifying the feature of cooling holes in the platform and the a trailing edge cutback feature.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method comprising:

providing a turbomachinery blade having an airfoil connected to a platform in a root region of the turbomachinery blade, the airfoil having a trailing edge extending from the root region to a tip distal from the root region;

forming a blind relief hole in the platform proximate the trailing edge of the airfoil; and forming a trailing edge cutback in the turbomachinery blade, wherein the cutback extends along the entire length of the trailing edge, wherein the cutback is formed with a first arc-shaped section proximate the root region, a second linear section which extends from the first arc-shaped section to an intermediate span of the blade, and a third linear section which extends from the second linear section to the tip, wherein the slope of the second linear section is different from the slope of the third linear section.

2. A turbomachinery blade comprising:

an airfoil connected to a platform in a root region of the turbomachinery blade, wherein the airfoil has a trailing edge extending from the root region to a tip distal from the root region;

a trailing edge cutback; and a blind relief hole in the platform proximate the trailing edge of the airfoil, wherein the cutback comprises:

a first arc-shaped section proximate the root region;

a second linear section which extends from the first arc-shaped section to an intermediate span of the blade; and a third linear section which extends from the second linear section to the tip, wherein the slope of the second linear section is different from the slope of the third linear section.

3. The turbomachinery blade according to claim 2, wherein the intermediate span of the blade is at the approximate mid-span of the blade.

4. A turbomachinery blade comprising:

an airfoil connected to a platform in a root region of the turbomachinery blade, wherein the airfoil has a trailing edge extending from the root region to a tip distal from the root region;

a trailing edge cutback; and a plurality of cooling holes in the platform, wherein the cutback comprises:

a first arc-shaped section proximate the root region;

a second linear section which extends from the first arc-shaped section to an intermediate span of the blade; and a third linear section which extends from the second linear section to the tip, wherein the slope of the second linear section is different from the slope of the third linear section.

5. The turbomachinery blade according to claim 4, wherein the plurality of cooling holes are formed such that the center axes of each of the cooling holes make an acute angle with the outside edge of the platform.

* * * * *

UNITED STATES PATENT AND TRADEMARK OFFICE

CERTIFICATE OF CORRECTION

PATENT NO. : 8,579,590 B2
APPLICATION NO. : 12/763422
DATED : November 12, 2013
INVENTOR(S) : Gregory M. Nadvit et al.

It is certified that error appears in the above-identified patent and that said Letters Patent is hereby corrected as shown below:

Title page, item [75] inventor after "Michel P. Arnal," insert --Turgi (CH)-- and delete "Turgt (CH)".

Signed and Sealed this
Fourth Day of February, 2014

Michelle K. Lee

Michelle K. Lee
*Deputy Director of the United States Patent and Trademark Office*